US007855690B2

(12) United States Patent
Höök et al.

(10) Patent No.: US 7,855,690 B2
(45) Date of Patent: Dec. 21, 2010

(54) ARRAY ANTENNA WITH ENHANCED SCANNING

(75) Inventors: Anders Höök, Hindås (SE); Joakim Johansson, Töllsjö (SE); Mats Gustafsson, Malmö (SE)

(73) Assignee: Telefonaktiebolaget L M Ericsson (PUBL), Stockholm (SE)

( * ) Notice: Subject to any disclaimer, the term of this patent is extended or adjusted under 35 U.S.C. 154(b) by 205 days.

(21) Appl. No.: 12/097,863

(22) PCT Filed: Dec. 23, 2005

(86) PCT No.: PCT/SE2005/002030

§ 371 (c)(1),
(2), (4) Date: Jun. 17, 2008

(87) PCT Pub. No.: WO2007/073266

PCT Pub. Date: Jun. 28, 2007

(65) Prior Publication Data

US 2009/0051619 A1 Feb. 26, 2009

(51) Int. Cl.
*H01Q 19/06* (2006.01)
*H01Q 21/12* (2006.01)
*H01Q 21/00* (2006.01)

(52) U.S. Cl. ..... 343/754; 343/812; 343/814; 343/816; 343/820

(58) Field of Classification Search ..... 343/795, 343/803, 810, 812, 813, 814, 815, 816, 817, 343/818, 819, 820, 754
See application file for complete search history.

(56) References Cited

U.S. PATENT DOCUMENTS

| | | | | |
|---|---|---|---|---|
| 4,122,447 | A * | 10/1978 | Kawai et al. | 343/814 |
| 5,936,590 | A * | 8/1999 | Funder | 343/795 |
| 6,317,099 | B1 * | 11/2001 | Zimmerman et al. | 343/803 |
| 2005/0219133 | A1 * | 10/2005 | Elliot | 343/757 |
| 2007/0091008 | A1 * | 4/2007 | Mortazawi et al. | 343/864 |

FOREIGN PATENT DOCUMENTS

| | | | |
|---|---|---|---|
| EP | 0590955 | A | 4/1994 |
| EP | 0884798 | A | 12/1998 |
| GB | 2 123 214 | A | 1/1984 |
| WO | WO 2004/107498 | A2 | 12/2004 |

* cited by examiner

*Primary Examiner*—Hoang V Nguyen

(57) ABSTRACT

The invention provides an improved array antenna, an array antenna system and an improved method for utilizing the improved array antenna and array antenna system. This is accomplished by an array antenna comprising a region of reference potential, e.g. a ground plane, and a spatially extended collection of at least two antenna elements capable of being at least partly balanced driven and at least partly unbalanced driven. The antenna elements have a first radiating element connected to a first port and a second radiating element connected to a second port. In other words, the antenna element has at least two ports. The radiating elements are arranged substantially adjacent and parallel to each other so as to extend at least a first distance approximately perpendicularly from said region of reference potential. The antenna element is further comprising a radiating arrangement connected to said first and said second radiating elements so as to extend at least a second distance above and approximately parallel to said region of ground reference.

6 Claims, 13 Drawing Sheets

ARRAY ANTENNA WITH ENHANCED SCANNING

This application is a 371 of PCT/SE2005/002030 dated Dec. 23, 2005.

FIELD OF THE INVENTION

The present invention relates to an array antenna for transmitting and receiving electromagnetic radiation and more particularly to an array antenna with an enhanced ability of steering the antenna lobe, especially the antenna lobe direction.

BACKGROUND OF THE INVENTION

Array antennas and particularly phased controlled array antennas have become increasingly attractive, not only for military applications but also for civil and commercial applications. Array antennas can be advantageously utilized in radar systems, in radio telescopes or in so-called base stations in a wireless telecommunication network etc. One of the most favourable properties of an array antenna and particularly a phased controlled array antenna is the increased ability to dynamically and very quickly re-forming and/or re-directing the antenna lobe.

In particular, this can be utilized to avoid transmitting and/or receiving interference signals to and from neighbouring transmitters and/or receivers. In many cases the antenna lobe can be formed and/or directed to avoid receiving and/or transmitting such disturbances. In radar systems this ability can e.g. be used to avoid hostile jamming sources. In cellular telecommunication system or similar this ability can e.g. be used to enhance the utilization of the available frequency spectrum, e.g. the frequency spectrum in a GSM-system, a CDMA-system, a WCDMA-system or other similar radio communication systems. This is only examples of applications. There is a vast spectrum of different applications, as is well-known.

The ability to dynamically and very quickly re-forming and/or re-directing the antenna lobe is also advantageous in that the antenna lobe can be directed to transmit and/or receive electromagnetic radiation to and/or from a small geographical area, which increases the energy efficiency of the antenna system. These and other advantages provided by array antennas and particularly by phased controlled array antennas are well-known in the art of array antennas and they need no further explanation.

An array antenna is basically a spatially extended collection of several substantially similar antenna elements. The expression "spatially extended" implies that each element has at least one neighbouring element that is placed at a close distance so as to avoid emission of electromagnetic radiation in ambiguous directions. The expression "similar" implies that preferably all elements have the same polar radiation patterns, orientated in the same direction in 3-d space. However, the elements do not have to be spaced on a regular grid, neither do they have to have the same terminal voltages, but it is assumed that they are all fed with the same frequency and that one can define a fixed amplitude and phase angle for the drive signal of each element.

By adjusting the relative phases of the respective signals feeding the antenna elements in an array antenna the effective radiation pattern (the antenna lobe) of the antenna can be reinforced in a desired direction and suppressed in undesired directions. The relative amplitudes of, and constructive and destructive interference effects among, the signals radiated by the individual antenna elements determine the effective radiation pattern of the array antenna. An ordinary array antenna can be used to accomplish a fixed radiation pattern (fixed antenna lobe), whereas a more sophisticated phase controlled array antenna can be used to rapidly scan the radiation pattern (the antenna lobe) in azimuth and/or elevation.

However, depending on the individual antenna elements chosen for the array antenna in question there is formally at least one direction in which the antenna lobe cannot be readily directed, i.e. there is at least one null point.

The individual antenna elements in an array antenna can e.g. be the well-known dipole 10 or similar, as schematically illustrated in FIGS. 1A-1D. The exemplifying dipole 10 in FIG. 1A comprises two opposite radiating elements 11*a*, 11*b*. The radiating elements 11*a*, 11*b* are preferably shaped as elongated threads, cylinders or rectangles so as to extend ¼ (λ/4) of the utilized wavelength along a horizontal axis DP1. Each radiating element 11*a*, 11*b* is individually connected to a feeding line 12*a*, 12*b* in a well-known manner for communicating high frequency signals to and from the dipole 10. Hence, formally the dipole 10 comprises two ports. One usually considers the balanced (or differential mode) current $I_{diff}=(I_1-I_2)/2$ to be the current that excites the dipole, where the power conveyed by $I_{diff}$ is supposed to convert to transmitted electromagnetic power. The differential mode is illustrated in FIG. 1A by a first current $I_+$ fed to the first feeding line 12*a* (the first port) and a second current $I_-$ fed to the second feeding line 12*b* (the second port). The two currents $I_+$, $I_-$ are of substantially equal magnitude but provided with opposite suffixes to indicate that they are out of phase by 180°, i.e. to indicate that the dipole 10 is operating according to a balanced or differential mode in a well-known manner. Balanced dual port dipole antennas like this have been studied extensively and can be made broadband and also scannable to a fair extent.

FIG. 1B illustrates a cross-section of a schematic radiation pattern from the dipole 10 cut along the axis DP1, and FIG. 1C illustrates a top view of said schematic radiation pattern, whereas FIG. 1D illustrates a schematic perspective view of the radiation pattern in FIGS. 1B-1C. As can be seen there is substantially no radiation emanating along the axis DP1, i.e. there is substantially no radiation from the short ends of the radiating elements 11*a*, 11*b*. This implies that an array antenna comprising a spatially extended collection of dipoles 10 will have a reduced ability to transmit electromagnetic radiation along the axis DP1 of the dipoles 10, as will be further described below. Naturally, the radiation pattern as now described is equally valid for reception.

The individual antenna elements in an array antenna may also be the well-known monopole 20 or similar, as schematically illustrated in FIGS. 2A-2D. The exemplifying monopole 20 in FIG. 2A has a single radiating element 21 extending ¼ (λ/4) of the utilized wavelength from a substantially horizontal ground plane 23 and along a substantially vertical axis MP. In other words, the monopole 20 is a quarter-wave antenna or a so-called Marconi antenna. The radiating element 21 is connected to a feeding line (not shown in FIG. 2*a*-2*d*) in a well-known manner for communicating high frequency signals to and from the monopole 20, and the radiating element 21 is fed by a single unbalanced current $I_+$ (not shown in FIG. 2*a*-2*d*) as is well-known in the art. Unbalanced single port monopole antennas like this have also been studied extensively.

FIG. 2B illustrates a cross-section of a schematic radiation pattern from the monopole 20 cut along the axis MP, and FIG. 2C illustrates a top-view of said schematic radiation pattern, whereas FIG. 2D illustrates a schematic perspective view of the radiation pattern in FIGS. 2B-2C. As can be seen there is substantially no radiation emanating along the axis MP, i.e. there is substantially no radiation emanating from the radiating element 21 along the normal to the ground plane 23. This implies that array antennas comprising a spatially extended collection of monopoles 20 will have a reduced ability to transmit electromagnetic radiation along the axis MP of the monopole, as will be further described below. Naturally, the radiation pattern as now described is also valid for reception.

The attention is now directed to a first exemplifying array antenna arrangement, illustrated in FIGS. 3A and 3B.

FIG. 3A is a schematic top view of an exemplifying array antenna 30 comprising an array of three dipoles 30*a*, 30*b*, 30*c*, e.g. such as the dipole 10 illustrated in FIGS. 1A-1D. The dipoles 30*a*-30*c* in FIG. 3A are collinearly arranged along an axis DP2 on the surface of a substantially flat substrate 33. As is well-known, the first dipole 30*a* has two radiating elements 31*aa*, 31*ab*, each connected to a feeding line 32*aa*, 32*ab*, whereas the second dipole 30*b* has two radiating elements 31*ba*, 31*bb*, each connected to a feeding line 32*ba*, 32*bb* and the third dipole 30*c* has two radiating elements 31*ca*, 31*cb*, each connected to a feeding line 32*ca*, 32*cb*.

FIG. 3B is a schematic side view of the exemplifying array antenna 30 in FIG. 3A. As can be seen, the collinear radiating elements 31*aa*-31*cb* and the feeding lines 32*aa*-32*cb* are arranged on the surface of the substrate 33 so as to extend in the same or an adjacent plane. As is well-known, the direction of maximum radiation (the main lobe) of an antenna as the array antenna 30 in FIG. 3A-3B is perpendicular to the horizontal plane in which the radiating elements 31*aa*-31*cb* extend. This has been indicated in FIG. 3B by a first arrow 35 extending perpendicularly upwards from the substrate 33, and a second arrow 35' extending perpendicularly downwards from the surface of the substrate 33. The second arrow 35' has been drawn by dashed lines to indicate that the radiation in this direction may be attenuated, stopped or reflected by the substrate 33, i.a. depending on the composition of the material in the substrate 33.

The type of array antenna schematically illustrated in FIGS. 3A-3B is generally referred to as "broad side array" antennas, since the radiation originates predominately from the broadside of the array than from the end side. Scanning the main lobe 35 of the broadside antenna 30 is achieved in a well-known manner by prescribing a certain phase increment $\psi$ between the antenna elements 30*a*, 30*b*, 30*c* in the scan direction $\Phi$. Consequently, a first signal $I_+$, $I_-$ with a first phase angle $\theta$ is feed to the first antenna element 30*a*; a second signal $I_+$, $I_-$ with a second phase angle $\theta+\psi$ is fed to the second antenna element 30*b* and a third signal $I_+$, $I_-$ with a third phase angle $\theta+2\psi$ is feed to the third antenna element 30*c*. The scanning itself is accomplished by varying the phase increment $\psi$, as is well-known in the art of phase controlled array antennas. The signals $I_+$, $I_-$ mentioned above have been provided with opposite suffixes to indicate that they are out of phase by 180°, i.e. to indicate that the dipoles 30*a*-30*c* operate according to a balanced or differential mode in a well-known manner.

However, as the phase increment $\psi$ increases so that the scan direction $\Phi$ of the main lobe 35 approaches 0°, i.e. approaches the horizontal direction in which the radiating elements 31*aa*-31*cb* extend, the impedance of the dipoles 30*a*-30*c* in the array antenna 30 changes in such a way that the matching deteriorates. This implies that an array antenna 30 comprising a spatially extended collection of dipoles 30*a*-30*c* or similar has a reduced ability to transmit electromagnetic radiation in directions that approaches the direction in which the radiating elements 31*aa*-31*cb* extend. In other words, there is substantially no radiation along the axis DP2, i.e. from the short ends of the radiating elements 31*aa*-31*cb*, which is consistent with the findings in connection with the single dipole 10 described above. Naturally, the radiation pattern as now described is also valid for reception.

The attention is now directed to a second exemplifying array antenna arrangement, illustrated in FIGS. 4A and 4B.

FIG. 4A is a schematic top view of an exemplifying array antenna 40 comprising an array of six monopoles 40*a*, 40*b*, 40*c*, 40*d*, 40*e*, 40*f*, e.g. such as the monopole 20 illustrated in FIGS. 2A-2D. Each monopole 40*a*-40*f* has a radiating element 41*a*-41*f*. The radiating elements 41*a*-41*f* are arranged in a straight line L1 on the surface of a flat ground plane 43. Each radiating element 41*a*-41*f* is furthermore connected to a feeding line 41*a*-41*f* in a well-known manner.

FIG. 4B is a schematic side view of the exemplifying array antenna 40 in FIG. 4A. The radiating elements 41*a*-41*f* extend from the surface of the ground plane 43 along vertical axes MPa-MPf, whereas the feeding lines 42*a*-42*f* are arranged in or adjacent to the ground plane 43. As is well-known, the possible directions of maximum radiation (the main lobes) of an antenna as the array antenna 40 extend along the line L1—i.e. along the line of radiating elements 41*a*-41*f*—and in parallel to the ground plane 43. This is indicated in FIG. 4B by a first arrow 45 to the right and a second arrow 45' to the left.

The type of array antenna 40 schematically illustrated in FIGS. 4A-4B is generally referred to as an "end-fire array" antenna, since the radiation originates predominately from the end of the array and not predominately from the broadside of the array as in the broad-side array antenna 30 in FIGS. 3A-3B. Some scanning of the main lobe 45, 45' of the end-fire array antenna 40 may be achieved in a well-known manner by prescribing a certain phase increment $\psi$ between the antenna elements 40*a*-40*f* in the scan direction $\Phi$. Consequently, a first signal $I_+$ with a first phase angle $\theta$ can be feed to the first antenna element 40*a*; a second signal $I_+$ with a second phase angle $\theta+\psi$ can be fed to the second antenna element 40*b*; a third signal I+with a third phase angle $\theta+2\psi$ can be feed to the third antenna element 40*c*, and so on to a sixth signal $I_+$ with a sixth phase angle $\theta+5\psi$ that is feed to the sixth antenna element 40*f*. The scanning is then accomplished by varying the phase increment $\psi$, as is well-known in the art of phase controlled array antennas. The signal $I_+$ have been provided with positive suffix to indicate that the signals fed to the monopole has the same original phase $\theta$, i.e. to indicate that the monopoles 40*a*-40*f* operate according to an unbalanced or sum-mode in a well-known manner.

However, as the phase increment $\psi$ increases so that the scan direction $\Phi$ of the main lobe 45 or 45' approaches 90°, i.e. approaches the vertical direction in which the radiating elements 41*a*-41*f* extend, the impedance of the antenna elements 40*a*-40*f* in the array antenna 40 changes in such a way that the matching deteriorates. This implies that an array antenna 40 comprising a spatially extended collection of monopoles 40*a*-40*f* or similar has a reduced ability to transmit electromagnetic radiation in directions that approaches the vertical direction in which the radiating elements 41*a*-41*f* extend. In other words, there is substantially no radiation along the axes MPa-MPf of the radiating elements 41*a*-41*f*, i.e. along the normal to the ground plane, which is consistent with the findings in connection with the single monopole 20 described above. Naturally, the radiation pattern as now described is also valid for reception.

To summarize, the well-known dipole 10 and the well-known monopole 20 and variations thereof are frequently used as single antenna elements in array antennas, e.g. as in the broadside antenna 30 in FIGS. 3A-3B and in the end-fire antenna 40 in FIGS. 4A-4B. However, almost without exception the antenna lobe of these single antenna elements have formally at least one null point, i.e. at least one direction in which the antenna element cannot not readily transmit and receive electromagnetic radiation. It follows that an array antenna comprising a spatially extended collection of several such antenna elements is typically showing at least one direction in which the antenna lobe of the array antenna cannot be readily directed, i.e. there is at least one null point in the antenna diagram of an array antenna comprising such antenna elements.

Consequently there is a need for an improved array antenna and particularly an array antenna with improved ability to direct the antenna lobe, especially so as to reduce possible null points.

SUMMARY OF THE INVENTION

The invention provides an improved array antenna, an array antenna system and an improved method of utilizing the improved array antenna and array antenna system.

This is accomplished by an array antenna comprising a region of reference potential, e.g. a ground plane, and a spatially extended collection of at least two antenna elements capable of being at least partly balanced driven and at least partly unbalanced driven. The antenna elements have a first radiating element connected to a first port and a second radiating element connected to a second port. In other words, the antenna element has at least two ports. The radiating elements are arranged substantially adjacent and parallel to each other so as to extend at least a first distance approximately perpendicularly from said region of reference potential. The antenna element is further comprising a radiating arrangement connected to said first and said second radiating elements so as to extend at least a second distance above and approximately parallel to said region of ground reference.

An embodiment of the invention comprises an array antenna wherein said radiating arrangement comprises a substantially continuous radiating element connected to said first radiating element and to said second radiating element. The continuous radiating element may e.g. be a loop element.

Another embodiment of the invention comprises an array antenna wherein said radiating arrangement comprises a third radiating element connected to said first radiating element and a fourth radiating element connected to said second radiating element.

A further embodiment of the invention comprises an array antenna wherein said third and fourth radiating element is chosen from a group of elements comprising: substantially straight thread shaped or cylindrically shaped elements; curved substantially loop shaped elements; substantially flat plate elements. The expression "flat plate elements" is intended to also comprise plate elements that are slightly curved.

The invention is also accomplished by an antenna system comprising an array antenna according to the above wherein the first and second ports of the antenna elements are connected to a feeding arrangement. The feeding arrangement is arranged so as to varying the phase difference $\phi$ between: a first signal $I_1$ communicated between the first port and the feeding arrangement; and a second signal $I_2$ communicated between the second port and the feeding arrangement.

An embodiment of the invention comprises a feeding arrangement comprising a device, e.g. a balun. The device is arranged so that a signal $I_0$ (e.g. $I_0e^{i(\psi n)}$) communicated with a first terminal SUM of the device is divided with a first substantially fixed phase difference $\phi_1$ (e.g. substantially 0°) between a first signal $I_1$ and a second signal $I_2$ communicated between the feeding arrangement and the antenna element. The device is further arranged so that a signal $I_0$ (e.g. $I_0e^{i(\psi n)}$) communicated with a second terminal DIFF of said device is divided with a second substantially fixed phase difference $\phi_2$ (e.g. substantially 180°) between a first signal $I_1$ and a second signal $I_2$ communicated between the feeding arrangement and the antenna element.

Said device may in an further embodiment have the first device terminal SUM and the second device terminal DIFF connected to a switch, which in a first position enables a signal $I_0$ to be communicated with the first device terminal SUM, and in a second position enables a signal $I_0$ to be communicated with the second device terminal DIFF.

Another embodiment of the invention comprises a feeding arrangement comprising a distribution arrangement (e.g. a combiner/divider) connected to said first and said second port and to a feeding line. The distribution arrangement is arranged so as to combine signals $I_1$, $I_2$ received from said ports into said feeding line, and to divide a signal $I_0$ (e.g. $I_0e^{i(\psi n)}$) received from said feeding line between said ports. The feeding arrangement is also comprising at least one phase shifter connected between at least one of said ports and said distribution arrangement so as to varying the phase $\phi$ of a signal communicated between that port and the distribution arrangement.

The invention is further accomplished by a method for transmitting or receiving by means of an array antenna comprising: a region of reference potential and a spatially extended collection of at least two antenna elements capable of being at least partly balanced driven and at least partly unbalanced driven. The antenna elements have a first radiating element connected to a first port and a second radiating element connected to a second port. In other words, the antenna element has at least two ports. The radiating elements are arranged substantially adjacent and parallel to each other so as to extend at least a first distance approximately perpendicularly from said region of reference potential. The antenna element is further comprising a radiating arrangement connected to said first and said second radiating elements so as to extend at least a second distance above and approximately parallel to said region of ground reference. The method includes the steps of transmitting or receiving electromagnetic radiation by the antenna elements in a variable direction by varying the phase difference $\phi$ between a first signal $I_1$ communicated with the first port of the antenna element and a second signal $I_2$ communicated with the second port.

A method according to an embodiment of the invention accomplishes the phase difference $\phi$ by using a feeding arrangement connected to the first and second port of each antenna element. The feeding arrangement is arranged to varying the phase difference $\phi$ between: a first signal $I_1$ communicated between said first port and said feeding arrangement; and a second signal $I_2$ communicated between said second port and said feeding arrangement.

An embodiment of the method uses a feeding arrangement comprising a device arranged so that a signal $I_0$ (e.g. $I_0e^{i(\psi n)}$) communicated with a first terminal SUM of the device is divided with a first substantially fixed phase difference $\phi$ (e.g. substantially 0°) between said first signal $I_1$ and said second signal $I_2$. The feeding device is further arranged so that a signal $I_0$ (e.g. $I_0e^{i(\psi n)}$) communicated with a second terminal DIFF of the device is divided with a second substantially fixed phase difference ($\phi$ (e.g. substantially 180°) between said first signal $I_1$ and said second signal $I_2$.

Said device may in an embodiment have the first device terminal SUM and the second device terminal DIFF connected to a switch, which is operated so that in a first position the signal $I_0$ is communicated with the first device terminal SUM, and so that in a second position the signal $I_0$ is communicated with the second device terminal DIFF.

Another embodiment of the method uses a feeding arrangement comprising a distribution arrangement (e.g. a combiner/divider) is connected to said first and second ports and to a feeding line; and being arranged so as to combine signals $I_1$, $I_2$ received from said ports into said feeding line, and to divide a signal $I_0$ (e.g. $I_0e^{i(\psi n)}$) received from said feeding line between said ports. The feeding arrangement is also comprising at least one phase shifter connected between at least one of said ports and said distribution arrangement so as to varying the phase $\phi$ of a signal communicated between that port and the distribution arrangement.

These and other aspects of the present invention will be apparent from the following description of embodiment(s) of the invention.

DETAILED DESCRIPTION OF PREFERRED EMBODIMENTS OF THE INVENTION

The present invention will now be described in more detail with reference to exemplifying embodiments thereof. Other embodiments of the invention are clearly conceivable and the invention is by no means limited to the exemplifying array antennas and feeding arrangements described below. It should also be added that the same or similar reference numbers used in the present text indicate the same or similar objects and/or functions throughout the whole text.

The Array Antenna

Figure 5A:
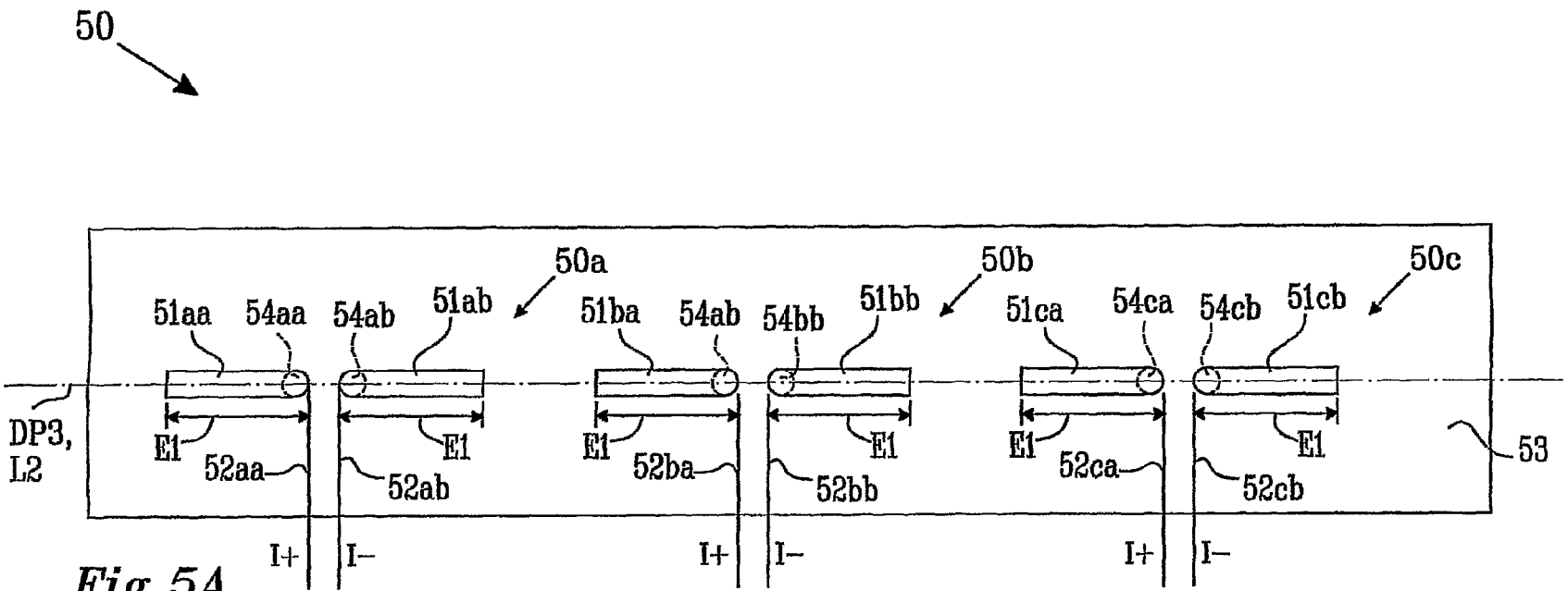
FIG. 5*a* is a schematic illustration of a top view of an array antenna 50 according to a preferred embodiment of the present invention.
Figure 5B:
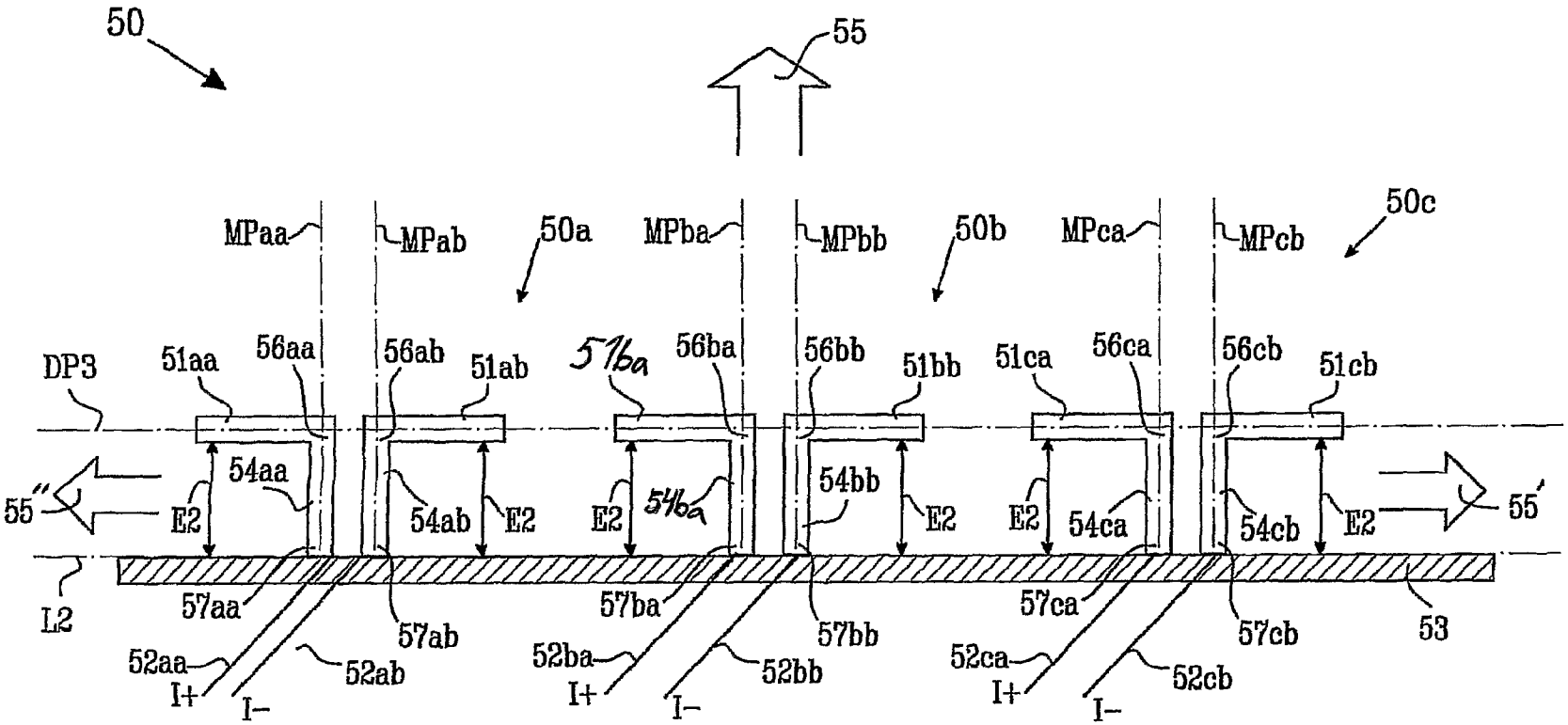
FIG. 5*b* is a schematic illustration of a side view of the array antenna 50 in FIG. 5*a*.

FIGS. 5A and 5B is a schematic illustration of an array antenna 50 according to a preferred embodiment of the present invention.

FIG. 5A is a schematic top view of the array antenna 50 comprising an array of three dipoles 50*a*, 50*b*, 50*c* substantially collinearly arranged along an axis DP3.

In particular:

- the first dipole 50*a* has two opposite and separated radiating elements 51*aa*, 51*ab*, each directly or at least indirectly connected to a feeding line 52*aa*, 52*ab;*
- the second dipole 50*b* has two opposite and separated radiating elements 51*ba*, 51*bb*, each directly or at least indirectly connected to a feeding line 52*bab*, 52*bb;*
- the third dipole 50*c* has two opposite and separated radiating elements 51*ca*, 51*cb*, each directly or at least indirectly connected to a feeding line 52*ca*, 52*cb*.

The radiating elements 51*aa*-51*cb* of the dipoles 50*a*-50*c* are preferably shaped as elongated threads, cylinders or rectangles extending a distance E1 of roughly ¼ (λ/4) of the utilized wavelength along the axis DP3. In other words, the dipoles 50*a*-50*c* are arranged in a similar way as the dipoles 30*a*-30*c* in the array antenna 30 described above with reference to FIGS. 3A-3B. However, other lengths and forms of the radiating elements 51*aa*-51*cb* are clearly conceivable, given that the function of radiating elements in a broadside array antenna can be substantially preserved. The length may e.g. assume other multiples of the utilized wavelength or even slightly depart from multiples of the utilized wavelength, whereas the form of a radiating element may e.g. be curved and/or extend at various angles etc.

FIG. 5B is a side view of the array antenna 50 in FIG. 5A, illustrating that each radiating element 51*aa*-51*cb* is substantially horizontally arranged on a vertical element 54*aa*-54*cb*, so as to extend a certain distance above a ground plane 53. A horizontal radiating element 51*aa*-51*cb* and a vertical element 54*aa*-54*cb* form an L-shaped structure (the L turned upside down and possibly rotated), whereas two adjacent vertical elements 54*aa*-54*cb* each provided with a horizontal radiating element 51*aa*-51*cb* form a T-shaped structure.

It is preferred that the above mentioned ground plane 53 is substantially flat and that the horizontal elements 51*aa*-51*cb* extend substantially in parallel to the ground plane 53, i.e. it is preferred that the ground plane 53 is substantially parallel to the axis DP3 along which the horizontal elements 51*aa*-51*cb* extend. However, other embodiments of the invention may have a ground plane 53 or a region of ground potential that is curved or assumes other shapes that wholly or partly depart from a flat shape. In some embodiments the ground plane 53 or region of ground potential may e.g. be formed by a grid of conductors or similar or even by a grid of point shaped ground regions.

Regarding the vertical elements 54*aa*-54*cb* illustrated in FIG. 5B it is preferred that they are electrically arranged so that the:

- upper distributing end 56*aa* of the vertical element 54*aa* is connected to the right end of the horizontal element 51*aa;*
- upper distributing end 56*ab* of the vertical element 54*ab* is connected to the left end of the horizontal element 51*ab;*
- upper distributing end 56*ba* of the vertical element 54*ba* is connected to the right end of the horizontal element 51*ba;*
- upper distributing end 56*bb* of the vertical element 54*bb* is connected to the left end of the horizontal element 51*bb;*
- upper distributing end 56*ca* of the vertical element 54*ca* is connected to the right end of the horizontal element 51*ca;*
- upper distributing end 56*cb* of the vertical element 54*cb* is connected to the left end of the horizontal element 51*cb;*
- lower feeding end 57*aa* of the vertical element 54*aa* is connected to the feeding line 52*aa;*
- lower feeding end 57*ab* of element 54*ab* is connected to the feeding line 52*ab;*
- lower feeding end 57*ba* of element 54*ba* is connected to the feeding line 52*ba;*
- lower feeding end 57*bb* of element 54*bb* is connected to the feeding line 52*bb;*
- lower feeding end 57*ca* of element 54*ca* is connected to the feeding line 52*ca;*
- lower feeding end 57*cb* of element 54*cb* is connected to the feeding line 52*cb.*

The feeding lines 52*aa*, 52*ab* connected to the feeding ends 57*aa*, 57*ab* respectively forms two ports, and feeding lines 52*ba*, 52*bb* connected to the feeding ends 57*ba*, 57*bb* respectively form another two ports, whereas the feeding lines 52*ca*, 52*cb* connected to the feeding ends 57*ca*, 57*cb* respectively forms still another two ports.

In addition, the vertical elements 54*aa*-54*cb* in FIG. 5B are preferably extending a distance E2 of roughly ¼ (λ/4) of the utilized wavelength from the horizontal ground plane 53 along vertical and substantially parallel axes MPaa-MPcb, i.e. the vertical elements 54*aa*-54*cb* are substantially perpendicular to the axis DP3 and the ground plane 53 in FIG. 5B. However, other lengths and forms of the vertical elements 54*aa*-54*cb* are clearly conceivable, given that the function of a radiating element in an end-fire array antenna can be substantially preserved, as will be explained further below. The length may e.g. assume other multiples of the utilized wavelength or even slightly depart from multiples of the utilized wavelength, whereas the form of a radiating element may be curved and/or extend at various angles etc.

As can be seen in FIGS. 5A-5B, the vertical elements 54*aa*-54*cb* are arranged in pairs 54*aa*, 54*ab*; 54*ba*, 54*bb*; 54*ca*, 54*cb* on the surface of the ground plane 53 and along a substantially straight line L2, which line L2 is preferably parallel or substantially parallel to the axis DP3. In other words, the vertical elements 54*aa*-54*cb* in FIGS. 5A-5B are arranged in a similar way as the monopoles 40*a*-40*f* in FIGS. 4A-4B, except that the monopoles 40*a*-40*f* in FIGS. 4A-4B are evenly spaced individuals whereas the vertical elements 54*aa*-54*cb* in FIGS. 5A-5B are adjacently arranged in substantially evenly spaced pairs.

It is preferred that the schematically illustrated feeding lines 52*aa*-52*cb* in FIGS. 5A-5B are arranged so as to extend in a plane adjacent to the preferred ground plane 53, i.e. above or beneath the ground plane 53. This arrangement of the feeding lines 52*aa*-52*cb* implies that the horizontal elements 51*aa*-51*cb* in FIGS. 5A-5B are not directly connected to the feeding lines 52*aa*-52*cb* but connected via the vertical elements 54*aa*-54*cb*. Hence, the horizontal elements 51*aa*-51*cb* may be consider as indirectly connected to the feeding lines 52*aa*-52*cb*. On the other hand, one may also consider the vertical elements 54*aa*-54*cb* as extensions of the feeding lines 52*aa*-52*cb*, i.e. as a being a part of the feeding lines 52*aa*-52*cb.*

Figure 3A:
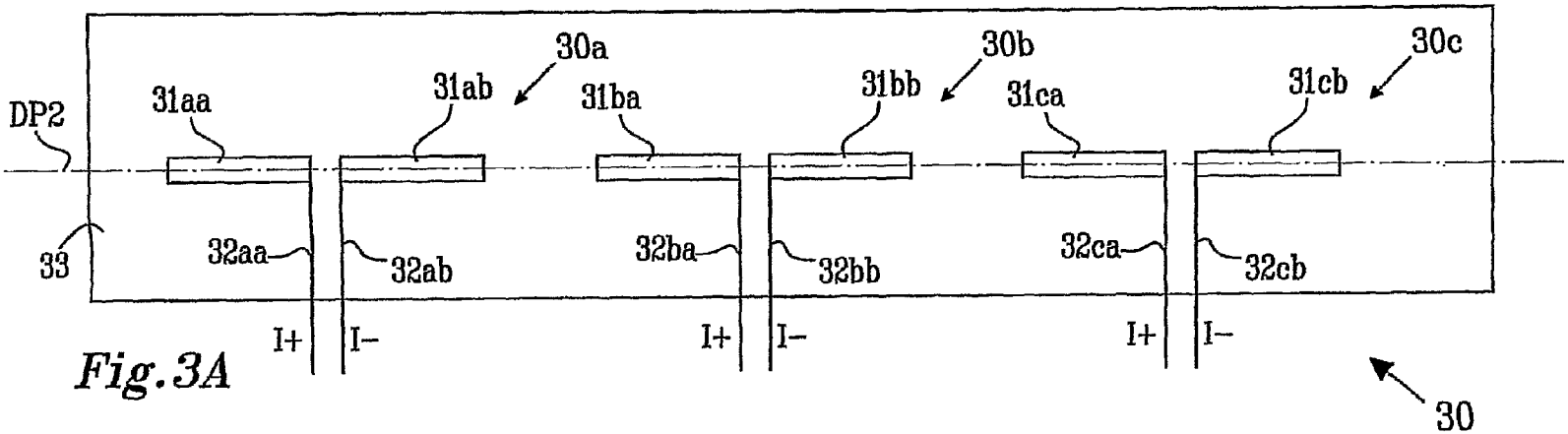
FIG. 3*a* is a schematic illustration of a top view of an exemplifying broadside array antenna 30.
Figure 3B:
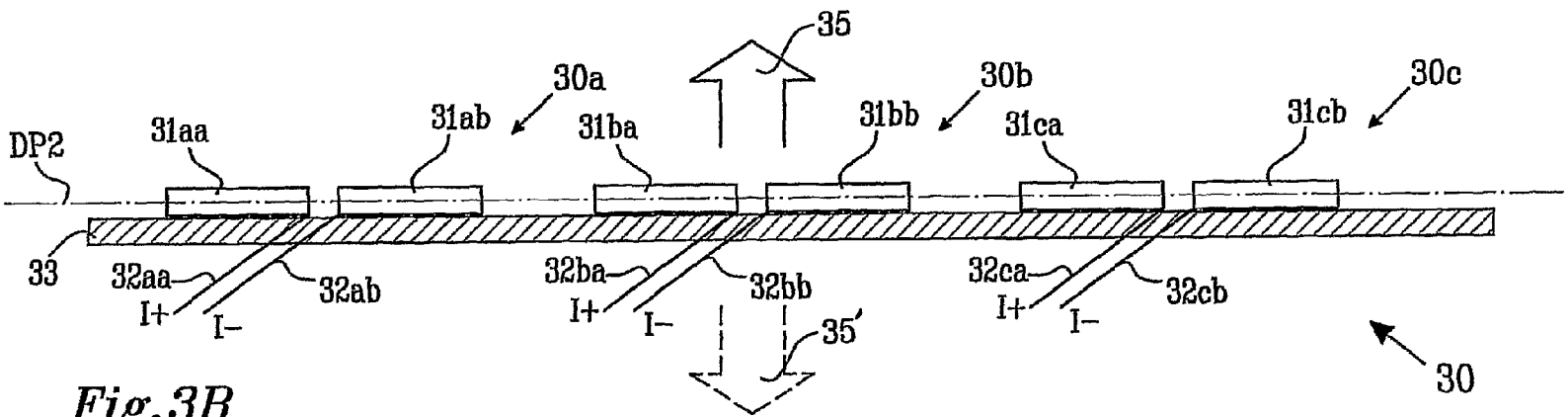
FIG. 3*b* is a schematic illustration of a side view of the array antenna 30 in FIG. 3*a*.

From the above it can be concluded that the substantially horizontal radiating elements 51*aa*-51*cb* of the array antenna 50 in FIGS. 5A-5B are similar to the horizontal radiating elements 31*aa*-31*cb* of the broadside array antenna 30 in FIGS. 3A-3B. It follows that the radiating elements 51*aa*-51*cb* can be utilized in the same way or at least in a similar way as the radiating elements 31*aa*-31*cb* of the broadside array antenna 30.

Figure 4A:
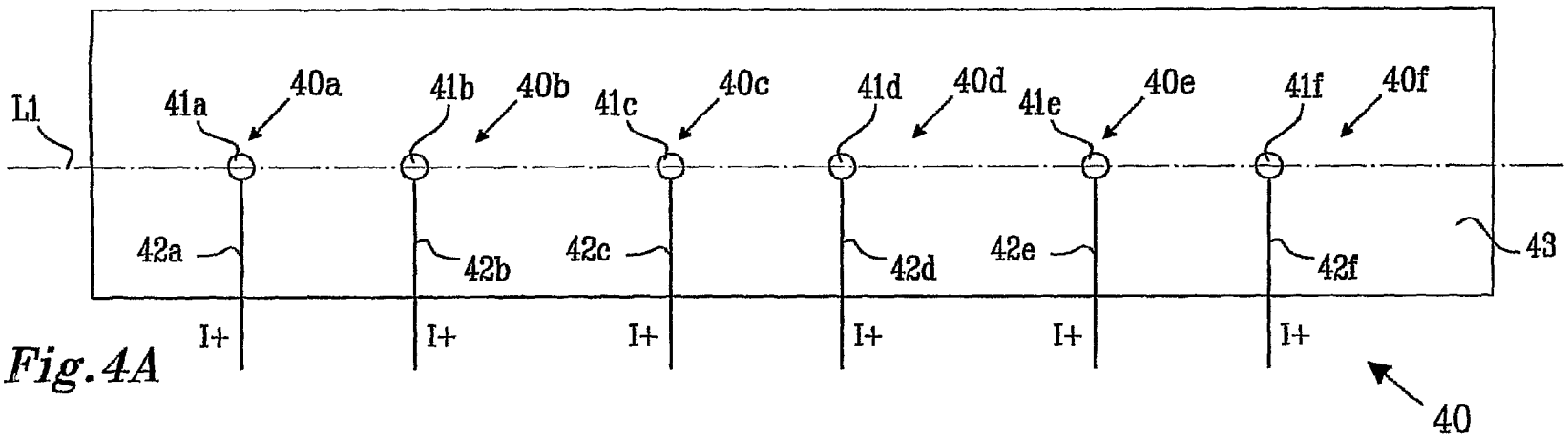
FIG. 4*a* is a schematic illustration of a top view of an exemplifying end-fire array antenna 40.
Figure 4B:
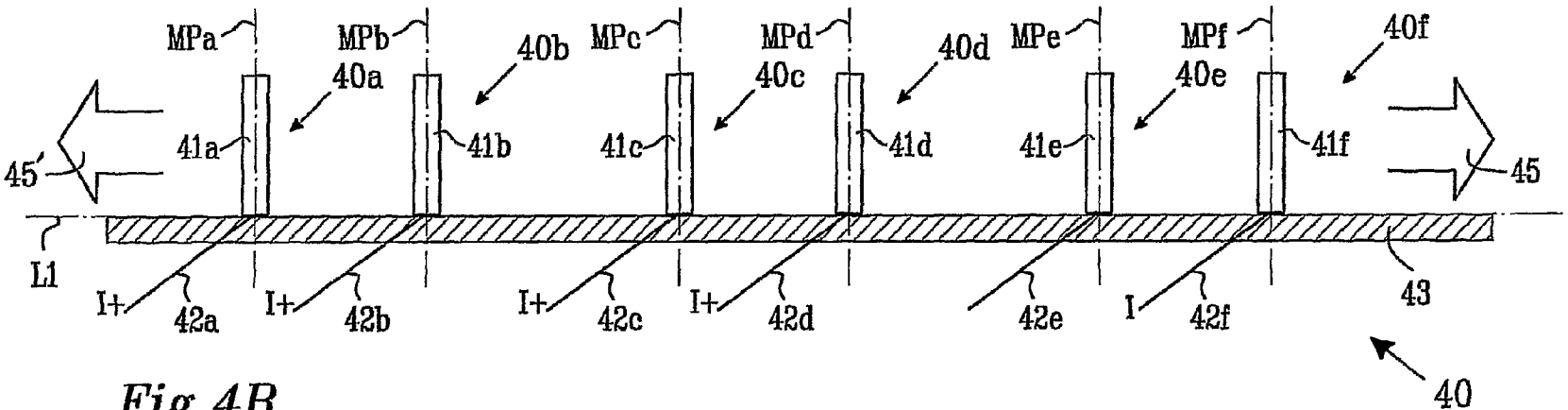
FIG. 4*b* is a schematic illustration of a side view of the array antenna 40 in FIG. 4*a*.

It can also be concluded from the above that the substantially vertical elements 54*aa*-54*cb* of the array antenna 50 in FIG. 5A-5B resembles the vertical radiating elements 41*a*-41*f* of the end-fire array antenna 40 in FIGS. 4A-4B. This resemblance is not accidental. In fact, the vertical elements 54*aa*-54*cb* of the array antenna 50 can be utilized in same way or at least in a similar way as the vertical elements 41*aa*-41*cb* of the end-fire array antenna 40, as will be further described below.

However, before we proceed it should be emphasised that the invention is not in any way limited to a single row of three collinear dipoles 50*a*-50*c* as shown in FIGS. 5A-5B. On the contrary, an array antenna according to the present invention may comprise anything from two antenna elements to a plurality of antenna elements arranged in one or several rows. In addition, the antenna elements must not necessarily be dipoles and the antenna elements must not necessarily be arranged in a line or in a row. On the contrary, the antenna elements or at least a subset of the antenna elements may be arranged at different heights and according to other patterns than rows, e.g. slightly departing from a row so as to form a zigzag-pattern or similar, or arranged in groups of several antenna elements where the groups (but not necessarily the individual antenna elements in a group) are arranged substantially in a row or similar. It should also be emphasised that the description of the horizontal radiating elements 51*aa*-51*cb* and the vertical elements 54*aa*-54*cb* should not be understood as limited to transmission of electromagnetic radiation. On the contrary, the description is equally valid for reception of electromagnetic radiation.

Scanning the Main Lobe

Figure 1A:
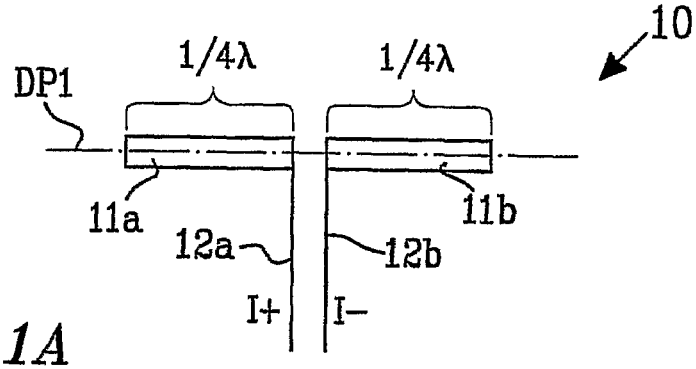
FIG. 1*a* is a schematic illustration of a side view of a well-known dipole 10.
Figure 1B:
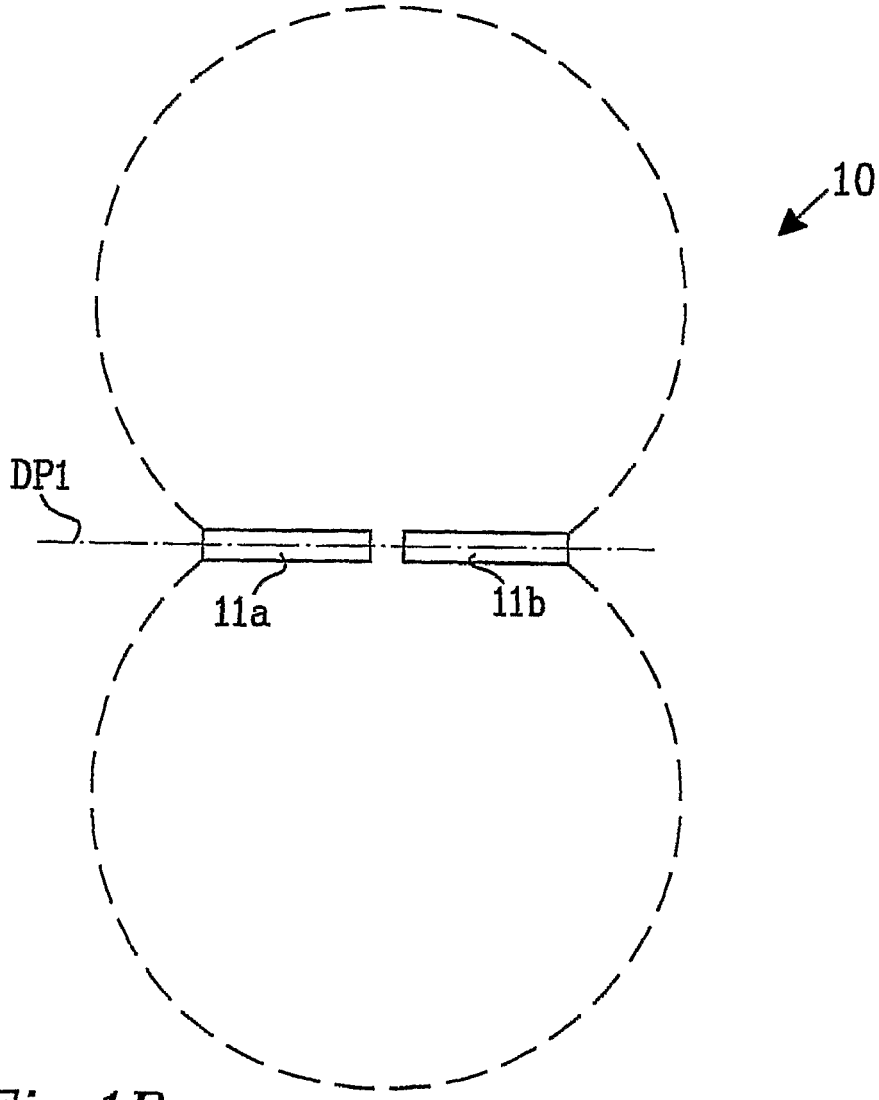
FIG. 1*b* is a schematic illustration of a cross-section of a radiation pattern from the dipole in FIG. 1*a*.
Figure 1C:
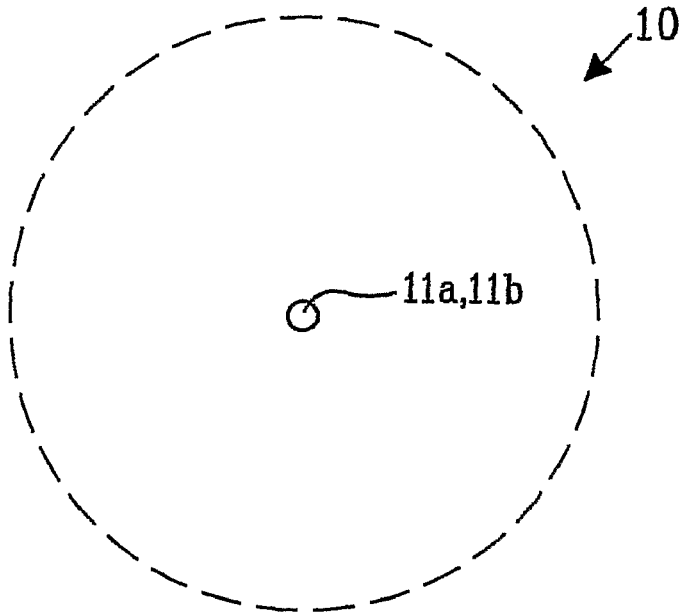
FIG. 1*c* is a schematic illustration of a top view of the radiation pattern in FIG. 1*b*.
Figure 1D:
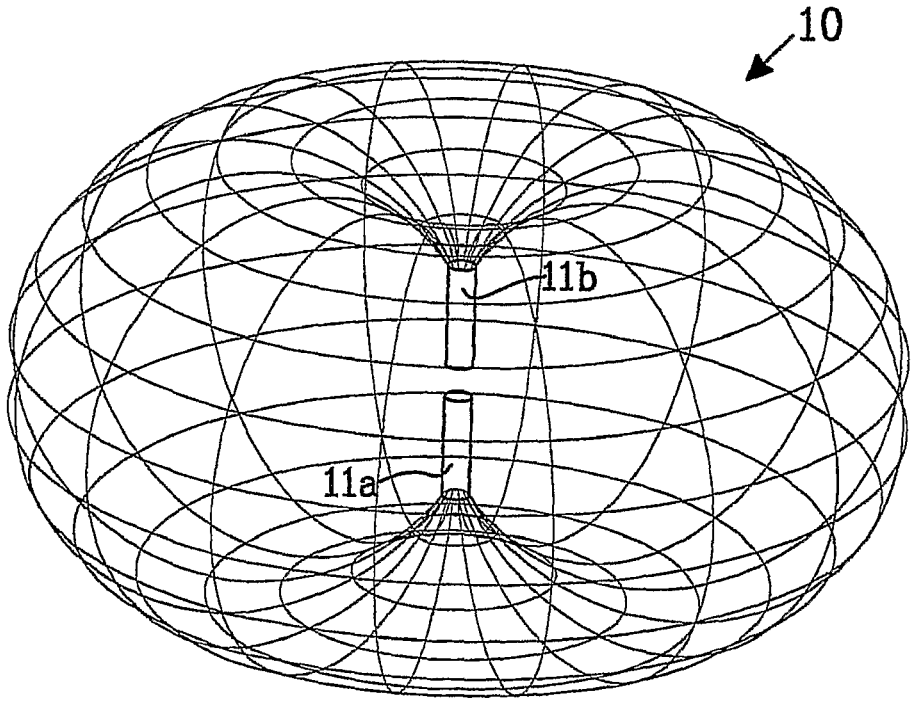
FIG. 1*d* is a schematic illustration of a perspective view of the radiation pattern in FIG. 1*b*-1*c*.
Figure 2A:
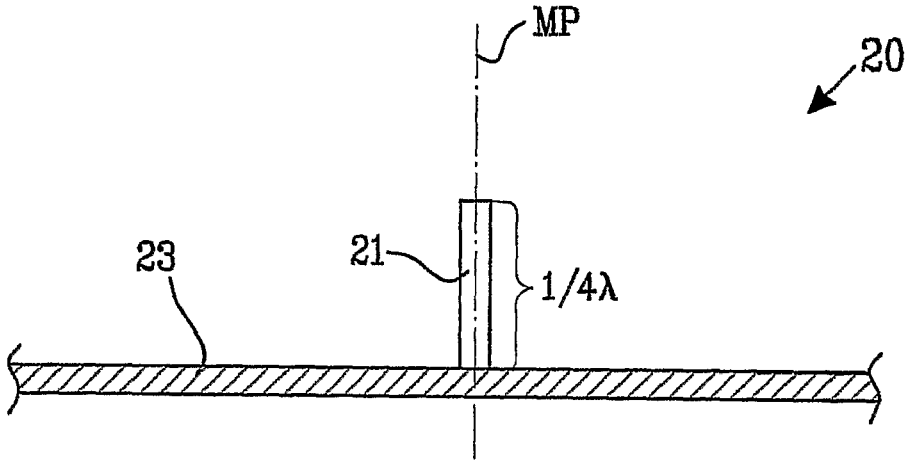
FIG. 2*a* is a schematic illustration of a side view of a well-known monopole 20.
Figure 2B:
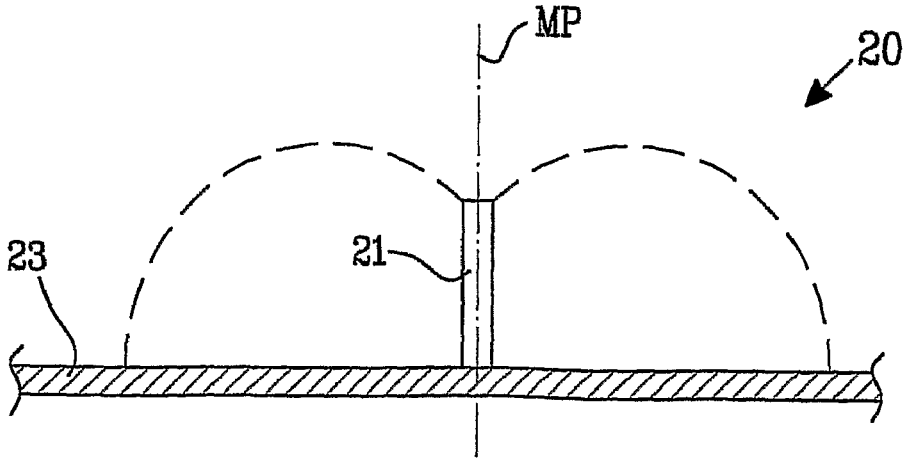
FIG. 2*b* is a schematic illustration of a cross-section of the radiation pattern from the monopole 20 in FIG. 2*a*.
Figure 2C:
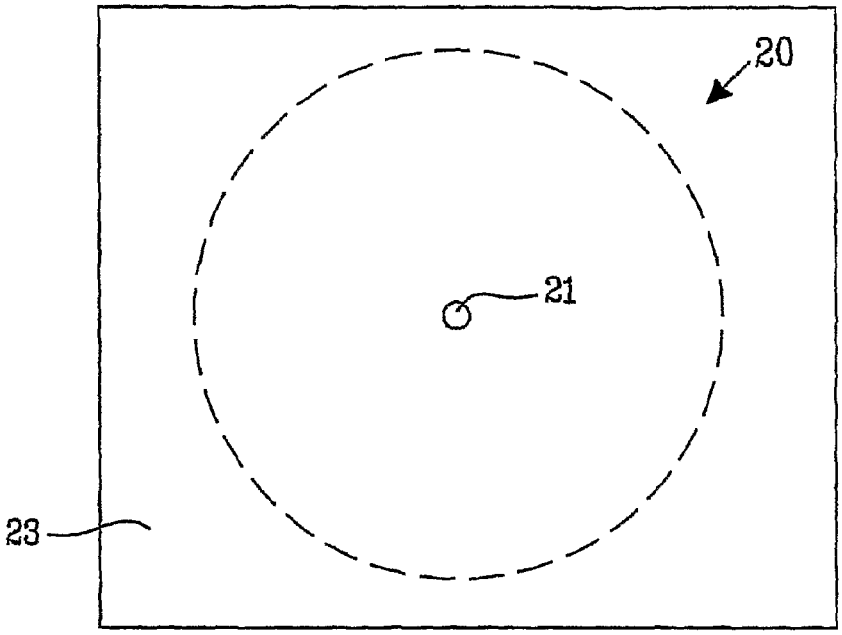
FIG. 2*c* is a schematic illustration of a top-view of the radiation pattern in FIG. 2*b*.
Figure 2D:
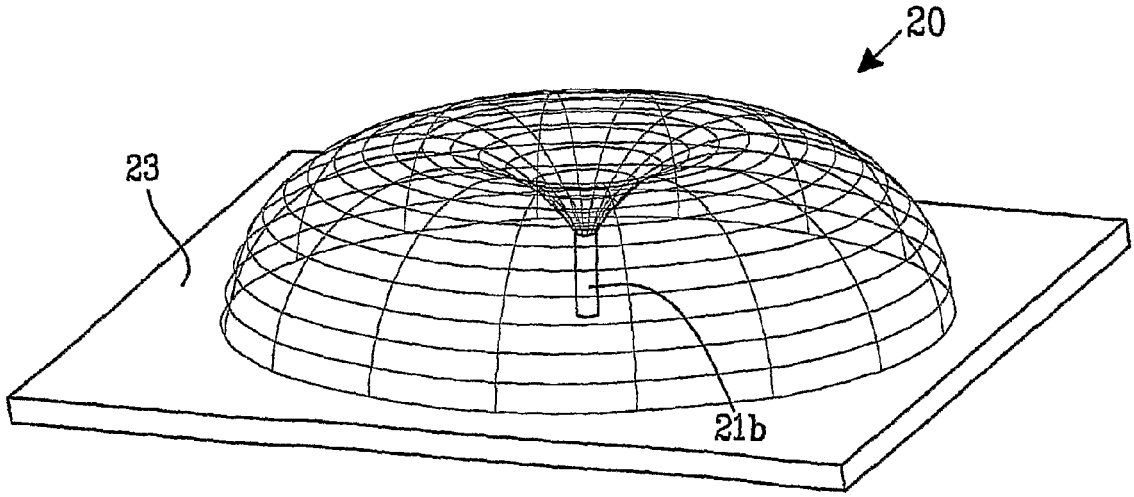
FIG. 2*d* is a schematic illustration of a perspective view of the radiation pattern in FIG. 2*b*-2*c*.

As previously explained in connection with the single dipole 10 in FIGS. 1A-1B one usually considers the balanced or differential mode current $I_{diff}=(I_1-I_2)/2$ to be the current that excites the dipole and the power conveyed by $I_{diff}$ is supposed to be converted to radiated electromagnetic power.

In accordance therewith, the differential mode for the three dipole antenna elements 30*a*, 30*b*, 30*c* of the array antenna 30—as described above with reference to FIGS. 3A-3B—has been illustrated by a first current $I_+$ fed to a first feeding line 32*aa*, 32*ba*, 32*ca* of the dipoles 30*a*, 30*b*, 30*c*, and a second current I_ fed to a second feeding line 32*ba*, 32*bb*, 32*cb* of the dipoles 30*a*, 30*b*, 30*c*. The currents $I_+$, I_ have opposite suffixes to indicate that they are out of phase by 180°, i.e. that the dipoles 30*a*, 30*b*, 30*c* operate according to a differential mode in a well known manner.

As previously established, the three dipoles 30*a*, 30*b* 30*c* of the array antenna 30 in FIGS. 3A-3B are similar to the three dipoles 50*a*, 50*b* 50*c* of the array antenna 50 in FIGS. 5A-5B. The dipoles 50*a*-50*c* of the array antenna 50 can therefore be excited in a differential or balanced mode in the same way or at least in a similar way as the dipoles 30*a*-30*c*, or for that matter in the same way or at least in a similar way as the dipole 10 in FIGS. 1A-1D.

Hence the dipoles 50*a*-50*c* can be excited by supplying the dipoles 50*a*, 50*b*, 50*c* with:

- a current $I_+$ to the first feeding line 52*aa* and a current I_ to the second feeding line 52*ab;*
- a current $I_+$ to the first feeding line 52*ba* and a current I_ to the second feeding line 52*bb;*
- a current $I_+$ to the first feeding line 52*ca* and a current I_ to the second feeding line 52*cb.*

The direction of maximum radiation (the main lobe) of the dipoles 50*a*-50*c* in a differential or balanced mode is substantially perpendicular to the axis DP3 along which the radiating elements 51*aa*-51*cb* extend. Hence, the main lobe is therefore also substantially perpendicular to the ground plane 53, as explained above. The main lobe has been indicated in FIG. 5B by an arrow 55 extending vertically and substantially perpendicularly upwards from the ground plane 53. As can be seen, the main lobe 55 that originates from the dipoles 50*a*-50*c* of the array antenna 50 in FIGS. 5A-5B is essentially the same as the main lobe 35 originating from the dipoles 30*a*-30*c* in the broadside array antenna 30 in FIGS. 3A-3B.

As previously explained in connection with the array antenna 30, the main lobe 55 of the antenna 50 can be scanned by prescribing a phase increment ψ between the antenna elements 50*a*-50*c* of the antenna 50. However, if the phase increment ψ increases so that the direction Φ of the main lobe approaches the direction in which the horizontal radiating elements 51*aa*-51*cb* extend in FIGS. 5A-5B, the impedance of the antenna elements 50*a*-50*c* changes in such a way that the matching deteriorates. The radiating elements 51*aa*-51*cb* of the dipoles 50*a*-50*c* in the array antenna 50 will therefore show a reduced ability to transmit electromagnetic radiation in the horizontal direction, i.e. along the line DP3 or in other words substantially perpendicular to the normal of the ground plane 53 in FIGS. 5A-5B. Consequently, there can be substantially no radiation from the dipoles 50*a*-50*c* of the array antenna 50 along the axis DP3 extending along the radiating elements 51*aa*-51*cb* and substantially in parallel to the horizontal ground plane 53 in FIG. 5B.

As a contrast, the end-fire array antenna 40 described above with reference to FIGS. 4A-4B has its main lobe(s) 45, 45' extending along the line L1 and along the horizontal ground plane 43 in FIGS. 4A-4B. However, the end-fire array antenna 40 has a reduced ability to transmit electromagnetic radiation in directions that approaches the vertical direction in which the radiating elements 41*a*-41*f* extend in FIG. 4B, i.e. in a direction substantially perpendicular to the ground plane 43.

Hence, it would be advantageous if the ability of the broadside array antenna 30 to transmit electromagnetic radiation in a vertical plane, as described above with reference to FIGS. 3A-3B, could be combined with the ability of the end-fire antenna 40 to transmit electromagnetic radiation in a horizontal plane, as described above with reference to FIGS. 4A-4B. This would give a considerable improvement of the possibility of directing the antenna lobe of the array antenna; especially in directions that are otherwise inaccessible, i.e. in the direction of so-called null points.

To this end, a similar function as the one of the monopoles in the end-fire array antenna 40 described above can be accomplished in the array antenna 50. In particular, this can be accomplished by utilizing the grouped pairs of elements 54*aa*, 54*ab*; 54*ba*, 54*bb*; 54*ca*, 54*cb* arranged substantially along the line L2 and extending in a substantially vertical direction from the ground plane 53.

Hence, the vertical elements 54*aa*-54*cb* of the dipoles 50*a*-50*c* in FIGS. 5A-5B are excited in a sum-mode (not shown in FIG. 5*a*-5*b*) by supplying the dipoles 50*a*, 50*b*, 50*c* with:

- a current $I_+$ to the first feeding line 52*aa* and a current $I_+$ to the second feeding line 52*ab;*
- a current $I_+$ to the first feeding line 52*ba* and a current $\mathbf{1}_+$ to the second feeding line 52*bb;*
- a current $I_+$ to the first feeding line 52*ca* and a current $I_+$ to the second feeding line 52*cb.*

In the sum-mode the radiation from the opposite pairs of horizontal elements 51*aa*, 51*ab*; 51*ba*, 51*bb*; 51*ca*, 51*cb* will substantially cancel each other, whereas each pair of adjacently arranged vertical elements 54*aa*, 54*ab*; 54*ba*, 54*bb*; 54*ca*, 54*cb* will essentially function as a single quarter-wave monopole, i.e. elements 51*aa*, 51*ab* will function as a first monopole, the elements 51*ba*, 51*bb* will function as a second monopole and the elements 51*ca*, 51*cb* will function as a third monopole in the sum-mode. Naturally, this presupposes that the vertical elements 54*aa*, 54*ab*; 54*ba*, 54*bb*; 54*ca*, 54*cb* in a pair are arranged close enough to be able to cooperate as a single monopole or similar and to allow the horizontal elements 51*aa*, 51*ab*; 51*ba*, 51*bb*; 51*ca*, 51*cb* in the pair to cooperate as a dipole or similar.

In addition, the radiation from the vertical elements of a pair 54*aa*, 54*ab*; 54*ba*, 54*bb*; 54*ca*, 54*cb* do essentially cancel each other when the dipoles 50*a*-50*c* are excited in a differential mode, since the currents in the elements of a pair have opposite directions in the differential mode.

From the above it follows that an excitation of the vertical elements 52*aa*-52*cb* of the antenna elements 50*a*-50*c* in a sum-mode enables the main antenna lobe 55 of the array antenna 50 to be pointed in a direction Φ that approaches or even coincides with the horizontal direction in which the radiating elements 51*aa*-51*cb* of the dipoles 50*a*-50*c* extend, i.e. substantially as the end-fire antenna 40 described above with reference to FIGS. 3A-3B. This is illustrated in FIG. 5B by two opposite arrows 55' and 55" representing the possible end-fire directions for the antenna lobe 55 of the array antenna 50.

In other words, the substantially horizontal elements 51*aa*-51*cb* of the array antenna 50 can be fed in a differential mode and utilized for radiating electromagnetic radiation in a similar way as a broadside dipole array antenna (e.g. as the broadside array antenna 30 in FIGS. 3A-3B), whereas the substantially vertical elements 54*aa*-54*cb* of the array antenna 50 can be fed in a sum-mode and utilized for radiating electromagnetic radiation in a similar way as an end-fire antenna (e.g. as the end-fire array antenna 40 in FIGS. 4A-4B).

The point of optimum switch-over between the differential mode and the sum-mode depend i.a. on the E-plane pattern cut for a single polarised antenna element.

The switch-over can be substantially continuous, e.g. a continuous decreasing of the 180° phase difference between the two currents $I_+$, I_ fed to the dipoles 50*a*-50*c* in a differential mode so as to approach and/or target the 0° phase difference between the currents $I_+$, $I_+$ fed to the dipoles 50*a*-50*c* in a sum-mode and back again.

The switch-over can also be a more or less two-way switching, e.g. a switch-over that simply toggles or switches between the 180° phase difference between the currents $I_+$, $I_-$ fed to the dipoles 50*a*-50*c* in a differential mode and the 0° phase difference between currents $I_+$, $I_+$ fed to the dipoles 50*a*-50*c* in a sum-mode.

In particular, a substantially continuous or step-less switch-over between a differential fed ($I_+$, $I_-$) and a sum fed ($I_+$, $I_+$) enables the array antenna 50 to transmit electromagnetic radiation in substantially any direction Φ along a half circle extending substantially perpendicularly from the ground plane 53 in the plane that is defined by the axis DP3 and the line L2, i.e. in the direction of the arrow 55 in FIGS. 5A-5B.

The point of optimum switch-over between the differential mode and the sum-mode, or the optimum mix of a differential mode and a sum-mode—i.e. the optimum phase difference between the two currents fed to a dipole 50*a*-50*c*—can e.g. be empirically determined by measuring the antenna pattern, as is well-known in the art. A measuring may e.g. be achieved by exciting the dipoles 50*a*-50*c* as described above, and prescribing a phase difference ϕ between the two feeding currents that is step-wise varied in a plurality of small steps from 0° to 180° (i.e. altering the excitation from a sum-mode 0° to a differential mode 180° by several small steps) and continuously measuring the electromagnetic radiation transmitted in different directions by the array antenna 50.

Naturally, the radiating (transmitting) ability as now described is equally valid for receiving, i.e. a suitably switching between a differential reception ($I_+$,$I_-$) and a sum reception ($I_+$, $I_+$) enables the array antenna 50 to receive electromagnetic radiation in substantially any direction Φ along a half circle extending substantially perpendicularly from the ground plane 53 in the plane that is defined by the axis DP3 and the line L2, i.e. in the direction of the arrow 55 in FIGS. 5A-5B. The point of optimum switch-over between the differential mode and the sum-mode or even the optimum mix of a differential mode and a sum-mode can therefore alternatively be measured by transmitting electromagnetic radiation towards the array antenna 50 from one direction after the other and continuously measure the phase and magnitude of the two currents received from each dipole 50*a*-50*c* in a well-known manner.

To achieve a suitable switch-over between a differential mode ($I_+$, $I_-$) and a sum-mode ($I_+$, $I_+$) it is preferred that the dipoles 50*a*-50*c* of the array antenna 50 is connected to a device that feeds the dipole antenna elements 50*a*-50*c* with an $I_{diff}=(I_1-I_2)/2$ and an $I_{sum}=(I_1+I_2)/2$ in a proportion that enhances or maximizes the power conversion to and from the dipole antenna elements 50*a*-50*c* of the array antenna 50. Preferred embodiment of such feeding devices will now be described with reference to FIGS. 6A-6C.

Figure 6A:
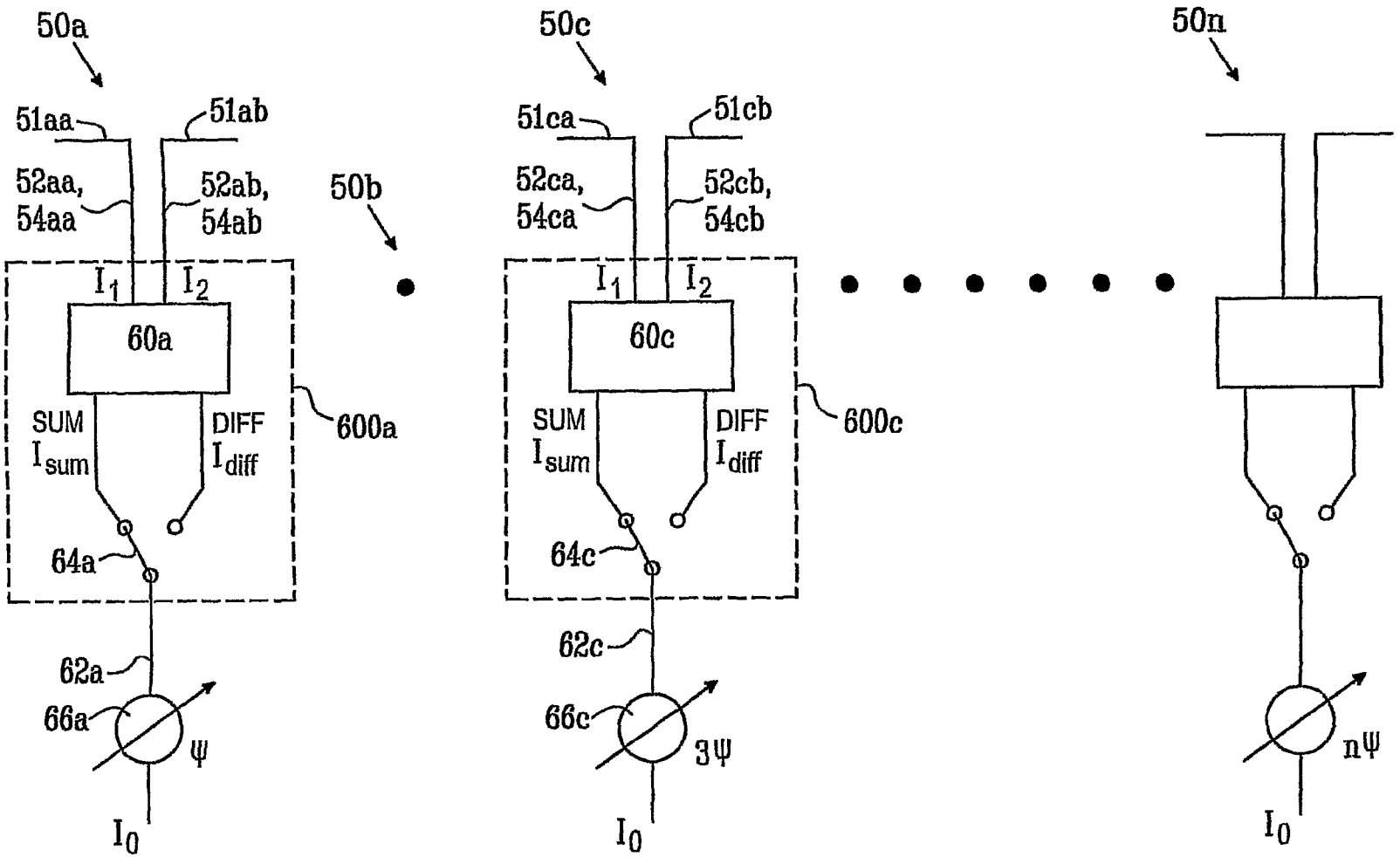
FIG. 6*a* is a schematic illustration of the array antenna 50 in FIG. 5*a*-5*b* provided with a feeding arrangement according to a first embodiment.
Figure 6B:
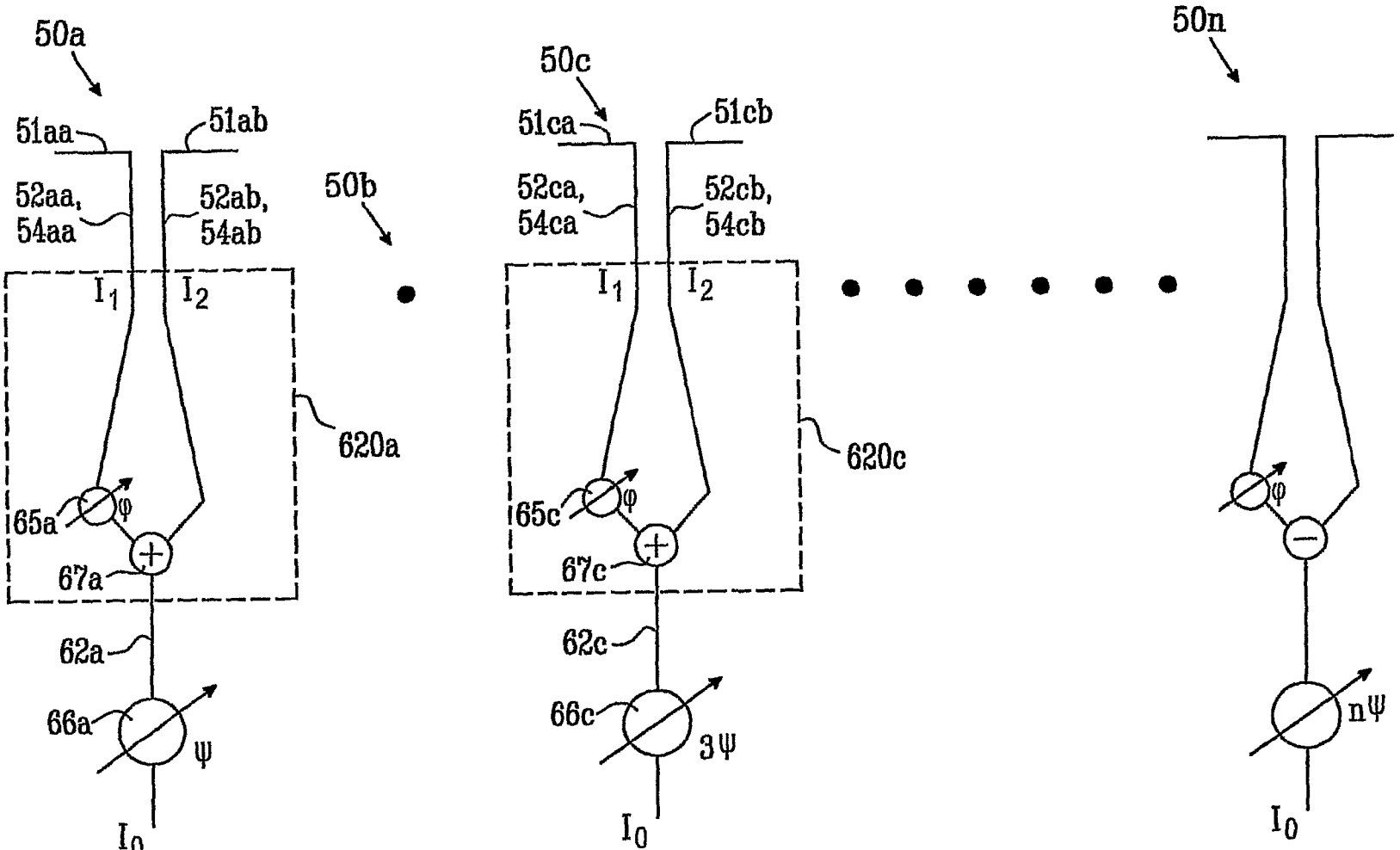
FIG. 6*b* is a schematic illustration of the array antenna 50 in FIG. 5*a* provided with a feeding arrangement according to a second embodiment.

FIGS. 6A-6B comprises schematic illustrations of the array antenna 50 in FIGS. 5A-5B. As can be seen, only the first dipole 50*a* and the third dipole 50*c* are illustrated. The connection and feeding of a single dipole antenna element 50*a* will be now described with reference FIGS. 6A-6B. It should be emphasized that the same is valid mutatis mutandis for the other dipole elements 50*b* and 50*c* in the array antenna 50 and further dipole elements 50*n* that may be arranged in an array antenna according to various embodiments of the present invention.

The dipole 50*a* is the same as the one illustrated in FIGS. 5A-5B. Consequently, the dipole 50*a* in FIG. 6A-6C has horizontal elements 51*aa*, 51*ab*, vertical elements 54*aa*, 54*ab* and feeding lines 52*aa*, 52*ab* in the same way as previously described with reference to FIGS. 5A-5B.

As can be seen in FIG. 6A a feeding arrangement 600*a* comprising a feeding device 60*a* and a two-way switch 64*a*. The feeding device 60*a* is connected to the feeding lines 52*aa*, 52*ab* of the dipole antenna element 50*a* so as to transmit and receive; a first current $I_1$ to and from the first feeding line 52*aa*, and a second current I2 to and from the second feeding line 52*ab*. Said feeding device 60*a* is provided with a first terminal SUM and a second terminal DIFF, which terminals are arranged to be alternately connected to a third feeding line 62*a* via the two-way switch 64*a*. The third feeding line 62*a* of the feeding arrangement 600*a* is in turn connected to a phase shifter 66*a* or similar for adding a possible phase increment ψ to the antenna element 50*a*, which enables a conventional scanning of the antenna lobe in a well-known manner as briefly describe above.

The feeding device 60*a* of the feeding arrangement 600*a* is preferably implemented by means of a balun or similar. A balun is a device that is particularly designed to convert between balanced (differential mode) and unbalanced (sum-mode) signals, as is well-known in the art. The balun 60*a* is typically implemented by means of a small isolation transformer, with the earth ground or chassis ground left floating or unconnected on the balanced side in a well-known manner. The balun 60*a* may also be implemented by means of e.g. a so-called Magic-T or T-Junction, which is a common and well-known component in the art. However, the invention is not limited to have the balun 60*a* implemented by means of an isolation transformer, a Magic-T or a T-Junction. On the contrary, the balun may be implemented by means of any other suitable device with the same or similar function as said transformer, Magic-T or T-Junction.

The function of the balun feeding device 60*a* in FIG. 6A is such that a current provided to the first terminal SUM of the device 60*a* is substantially equally divided into two currents $I_1=I_{sum\angle 0°}/2$ and $I_2=I_{sum\angle 0°}/2$, which currents are provided from the device 60*a* to the antenna element 50*a* with a 0° phase difference, i.e. the two currents $I_1$ and $I_2$ are in phase and the antenna element 50*a* is therefore excited in a sum-mode, c.f. the currents $I_+$, $I_+$ discussed above. Similarly, a current provided to the second terminal DIFF of the device 60*a* is equally divided into two currents $I_1=I_{diff\angle 180°}/2$ and $I_2=I_{diff\angle 0°}/2$. However, these two currents are provided from the device 60*a* to the antenna element 50*a* with a 180° phase difference, i.e. the two currents $I_1$ and $I_2$ are now out of phase and the antenna element 50*a* is therefore excited in a differential mode, c.f. the currents $I_+$, $I_-$ discussed above.

It follows that the antenna element 50*a* can transmit electromagnetic radiation in a sum-mode (unbalanced or end-fire mode) or in a differential mode (balanced or broadside mode) as required by toggling the two-way switch 64*aa* depending on the direction Φ in which the antenna lobe 55 of the array antenna 50 is intended to radiate.

The expressions below may clarify the function of a feeding device (60*a*, 60*b*, 60*c* . . . 60*n*).

If the input signal to the DIFF terminal is zero and the input signal to the SUM terminal is $I_{SUM}=I_0e^{i(\psi n)}$, wherein $\psi_n$ represents the phase increment for the antenna element, in question, then:

$$I_n^1=I_0^{'}e^{i(\psi n)} \quad [1]$$

$$I_n^2=I_0^{'}e^{i(\psi n)} \quad [2]$$

wherein $I_0^{'}$ is the current $I_0$ adjusted for possible losses etc in the feeding device (60*a*, 60*b*, 60*c* . . . 60*n*) in question, and wherein $I_n^1$ is the current $I_1$ for the antenna element in question, and wherein $I_n^2$ is the current $I_2$ for the antenna element in question.

If the input signal to the SUM terminal is zero and the input signal to the DIFF terminal is $I_{DIFF}=I_0e^{i(\psi n)}$, wherein ψn represents the phase increment for the antenna element in question, then:

$$I_n^1=I_0'e^{i(\psi n+\pi/2)} \quad [3]$$

$$I_n^2=I_0'e^{i(\psi n-\pi/2)} \quad [4]$$

wherein $I_0'$ is the current $I_0$ adjusted for possible losses etc in the feeding device (60*a*, 60*b*, 60*c* . . . 60*n*) in question, and wherein $I_n^1$ is the current $I_1$ for the antenna element in question, and wherein $I_n^2$ is the current $I_2$ for the antenna element in question.

Naturally, the radiating (transmitting) ability as now described is equally valid for receiving, i.e. the antenna element 50*a* can receive electromagnetic radiation in a sum-mode (unbalanced or end-fire mode) or in a differential mode (balanced or broadside mode) as required depending on the direction Φ from which the antenna lobe 55 of the array antenna 50 is intended to receive.

However, a balun feeding device 60*a* or similar as described above is not necessarily required in certain embodiments of a feeding arrangement according to the present invention. This is illustrated In FIG. 6B wherein the balun feeding device 60*a* has been omitted. Instead, the feeding line 52*ab* of the dipole 50*a* has been connected to a power divider/combiner 67*a*, i.e. not to a balun 60*a* or similar as in the feeding arrangement 600*a* in FIG. 6A. Similarly, the feeding line 52*aa* of the dipole 50*a* is not connected to a balun 60*a* or similar as in the feeding arrangement 600*a*, but to a phase shifter 65*a*, which in turn is connected to said power divider/combiner 67*a*. The divider/combiner 67*a* can e.g. be implemented by means of waveguides or similar as is well known in the art.

If the input signal to the power divider/combiner 67*a* in FIG. 6B is $I_{div/comb}=I_0e^{i(\psi n)}$, wherein ψn represents the phase increment for the antenna element in question, then:

$$I_n^1=I_0'e^{i(\psi n+\phi)}=I_0'e^{i(\psi n+\phi/2)}\cdot e^{i(\phi/2)} \quad [5]$$

$$I_n^2=I_0'e^{i(\psi n)}=I_0'e^{i(\psi n+\phi/2)}\cdot e^{-i(\phi/2)} \quad [6]$$

wherein $I_0'$ is the current $I_0$ adjusted for possible losses etc in the divider/combiner 67*a*, and wherein ϕ represents the phase shift added by the phase shifter 65*a*, and wherein $I_n^1$ is the current $I_1$ for the antenna element in question, and wherein $I_n^2$ is the current $I_2$ for the antenna element in question.

It is clear from equations 5 and 6 that the phase shifter 65*a* in the feeding arrangement 620*a* in FIG. 6B enables a substantially continuous alteration of the phase between the two currents $I_1$, $I_2$, e.g. a substantially continuous alteration from a 0° phase difference to a 180° phase difference between the two currents $I_1$, $I_2$. This enables a mix of the sum-mode and the differential mode, i.e. a mix of the unbalanced mode and the balanced mode. In other words, the phase shifter 65*a* enables a simultaneous utilization of the horizontal elements 51*aa*, 51*ab* and the vertical elements 52*aa*, 52*ab* in various amounts for transmitting and/or receiving, i.e. the horizontal elements 51*aa*, 61*ab* can transmit in a certain amount at the same time as the vertical elements 52*aa*, 52*ab* transmit in a certain amount, which also holds for receive.

The invention has now been described by means of exemplifying embodiments. However, it should be emphasized that the invention is by no means limited to the embodiments now described. On the contrary, the invention is intended to comprise all embodiments covered by the scope of the appended claims. For example, the invention is by no means limited to a single row of three collinear dipoles 50*a*-50*c* as shown in FIGS. 5A-5B and 6A-6B. On the contrary, an array antenna according to the present invention may comprise anything from two antenna elements to a plurality of antenna elements that are arranged in one or several rows. Further, the antenna elements must not necessarily be arranged in a line or a row. On the contrary, the antenna elements or at least a subset of the antenna elements may be arranged according to other patterns than rows. It should also be emphasised that the description of the substantially horizontal elements 51*aa*-51*cb* and the substantially vertical elements 54*aa*-54*cb* is applicable mutatis mutandis for both transmitting and receiving.

In addition, the antenna elements must not necessarily be a traditional dipole.

Figure 7A:
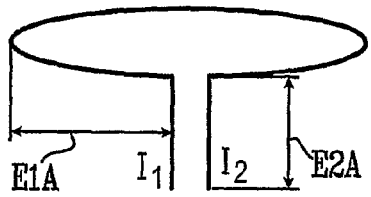
FIG. 7*a* is a schematic illustration of a loop antenna element.
Figure 7B:
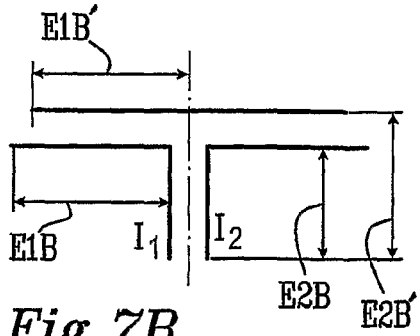
FIG. 7*b* is a schematic illustration of a dipole having a parasitic or resonator element.

In one embodiment the antenna element may e.g. be a loop antenna as the one schematically illustrated in FIG. 7A. The loop antenna comprises a loop having one ore several turns and extends at least a first distance E1A substantially in parallel to a ground plane (not shown) and at least a second distance E2A substantially perpendicular to said ground plane, Another embodiment of the invention may utilize a dipole antenna element having a parasitic or resonator element extending in parallel to the horizontal radiating elements, as schematically illustrated in FIG. 7B. The dipole antenna element in FIG. 7B extends at least a first distance E1B substantially in parallel to a ground plane (not shown) and at least a second distance E2B substantially perpendicular to said ground plane, whereas the parasitic element extends a third distance E1B' substantially in parallel to said ground plane and at least a fourth distance E2B' substantially perpendicular to said ground plane.

Figure 7C:
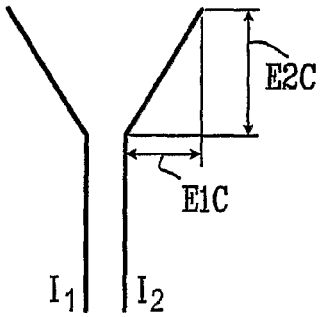
FIG. 7*c* is a schematic illustration of a dipole having tilted dipole arms.

Moreover, the antenna element in an embodiment of the invention may be a dipole that has tilted radiating elements e.g. as the V-shaped antenna element schematically illustrated in FIG. 7C. The V-shaped dipole antenna in FIG. 7C extends at least a first distance E1C substantially in parallel to a ground plane (not shown) and at least a second distance E2C substantially perpendicular to said ground plane.

Figure 7D:
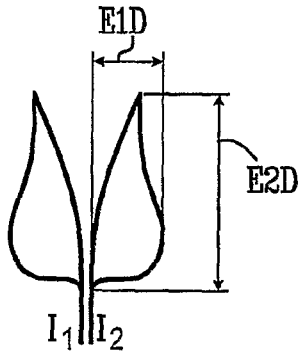
FIG. 7*d* is a schematic illustration of a double probe fed bunny-ear antenna element.

In addition, the antenna element in an embodiment of the invention may be a so-called Bunny-Ear antenna, e.g. as the bunny ear antenna schematically illustrated in FIG. 7D. The bunny-Ear antenna in FIG. 7D extends at least a first distance E1D substantially in parallel to a ground plane (not shown) and at least a second distance E2D substantially perpendicular to said ground plane.

Figure 7E:
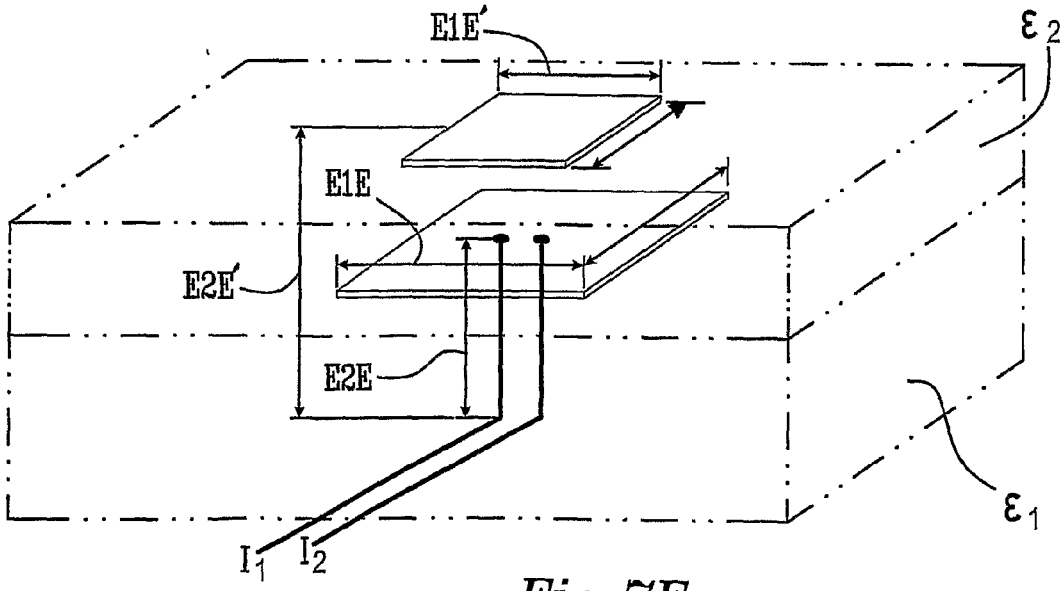
FIG. 7*e* is a schematic illustration of a double probe fed patch antenna element having a parasitic or resonator element.

Furthermore, some embodiments of the invention may utilize an antenna element in the form of a patch antenna, as schematically illustrated in FIG. 7E. The exemplifying patch antenna in FIG. 7E comprises a first substantially flat plate forming an antenna element arranged in a well known manner on a first substrate having a first dielectric constant $\in_1$, which substrate in turn is arranged on a ground plane (not shown). The patch antenna element extends at least a first distance E1E above and substantially in parallel to said ground plane and it is feed by two substantially parallel feeding lines extending at least a second distance E2E substantially perpendicular to said ground plane. In analogy with the parasitic element shown in FIG. 7B the patch antenna in FIG. 7E may also have a parasitic element arranged on a second substrate having a second dielectric constant $\in_2$. The parasitic element may e.g. be a substantially flat plate extending a third distance E1E' substantially in parallel to said ground plane and at least a fourth distance E2E' substantially perpendicular to said ground plane.

Figure 7F:
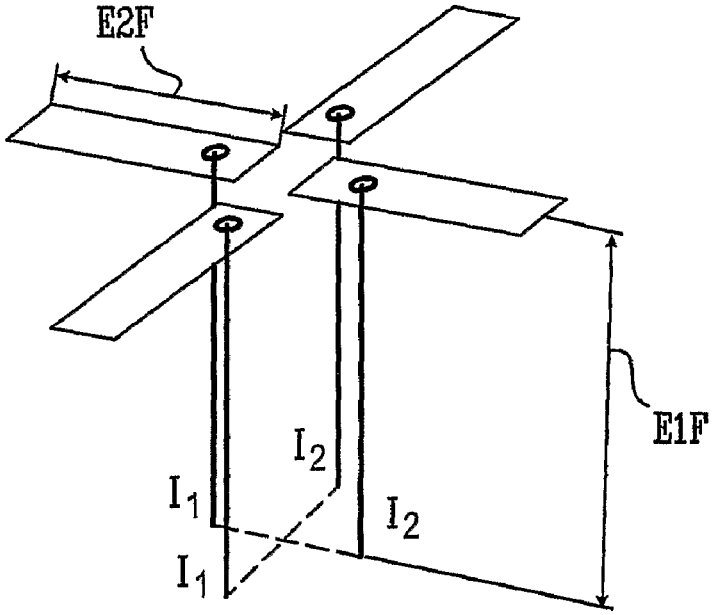
FIG. 7*f* is schematic illustration of a double polarized embodiment of a dipole antenna element.

The antenna element in an embodiment of the invention may also be a double polarized antenna element, e.g. as the double polarized antenna element shown in FIG. 7F comprising two dipoles displaced 90° with respect to each other, as is well known in connection with double polarized antenna elements. The dipole antenna may e.g. based on a dipole antenna element such as the dipoles 50*a*-50*c* shown in FIGS. 5A-5B. Hence, the double polarized antenna element in FIG. 7F extends at least a first distance E1F above and substantially in parallel to a ground plane (not shown) and then at least a second distance E2F substantially perpendicular to said ground plane.

Figure 7G:
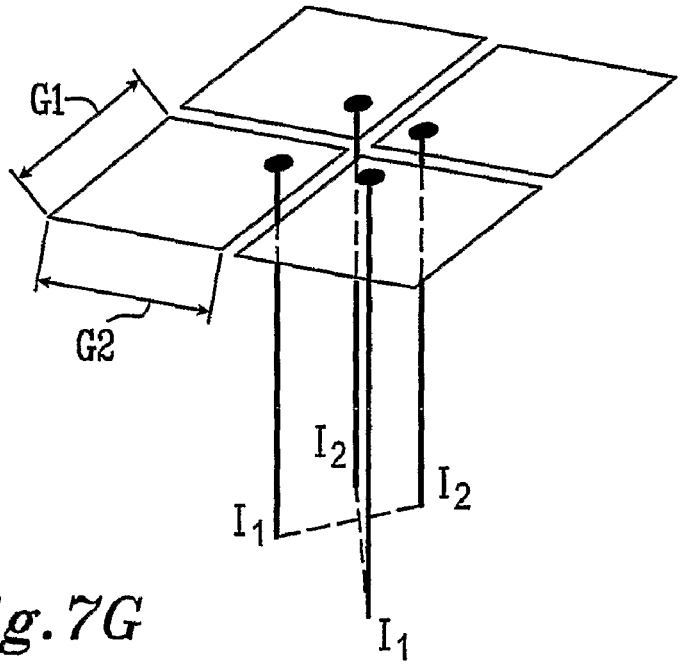
FIG. 7*g* is schematic illustration of a double polarized embodiment of a dipole antenna element known as the four-square antenna element.

FIG. 7G is schematic illustration of another exemplifying double polarized embodiment of a dipole antenna element known as the four-square antenna element. The four-square antenna element comprises two dipoles each comprising two substantially square-shaped plates. The four plates are arranged in a square formation so that the dipoles are displaced 90° with respect to each other. A feeding probe is provided at the corner of each square plate closest to the center of the square formation. The plates are arranged at least a first distance above and substantially parallel to a ground plane (not shown) and then at least a second distance substantially perpendicular to said ground plane.

Figure 7H:
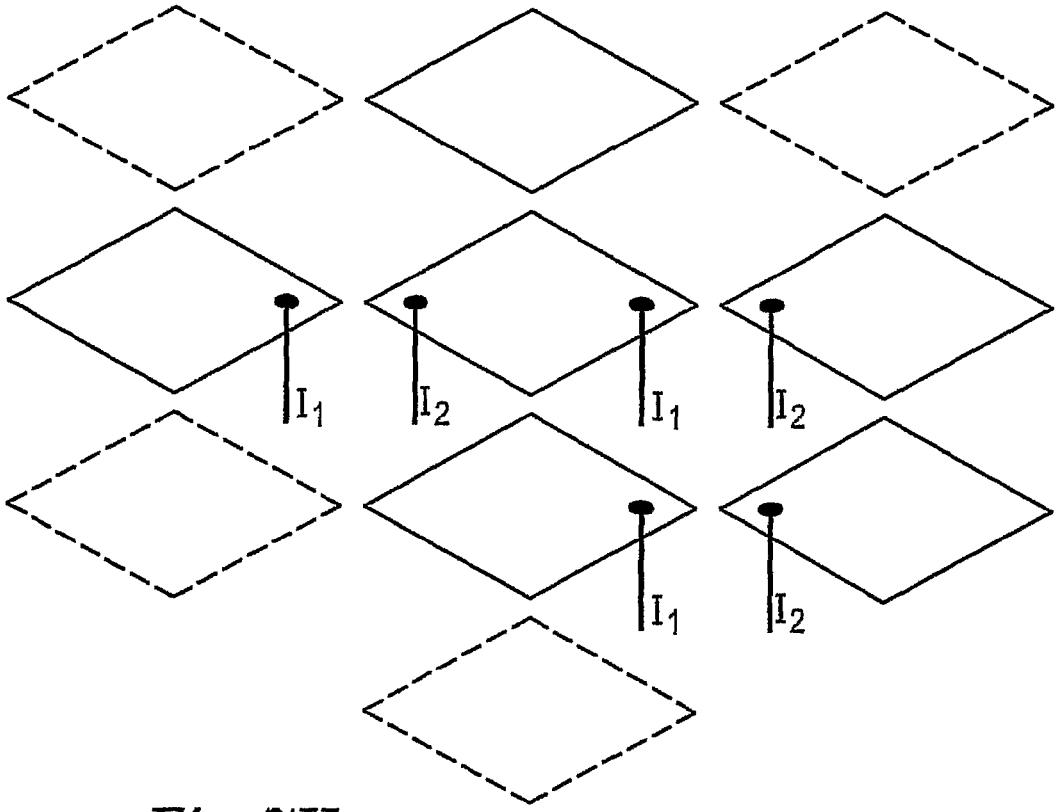
FIG. 7*h* is a schematic illustration of a patch element array antenna with a corner feeding arrangement.

FIG. 7H is a schematic illustration of a patch element array antenna with a corner feeding arrangement. The patch element may e.g. be similar to the patch element schematically illustrated in FIG. 7E. The patch elements in FIG. 7H are arranged in a chessboard pattern, wherein each feeding probe pair carrying the currents I1, I2 connects to the closely spaced corners of two neighboring patches. This embodiment may also be provided with additional probe pairs enabling double polarization.

Any of the antenna elements discussed above can be combined with one or several dielectric layers above and/or below the element such as to modify the SUM and DIFF mode scan patterns.

REFERENCE SIGNS

10 Dipole
11*a* Radiating Element
11*b* Radiating Element
12*a* Feeding Line
12*b* Feeding Line
20 Monopole
21 Vertical Radiating Element
23 Horizontal Ground Plane
30 Broadside Array Antenna
30*a* Dipole
30*b* Dipole
30*c* Dipole
31*aa* Radiating Element
31*ab* Radiating Element
31*ba* Radiating Element
31*bb* Radiating Element
31*ca* Radiating Element
31*cb* Radiating Element
32*aa* Feeding Line
32*ab* Feeding Line
32*ba* Feeding Line
32*bb* Feeding Line
32*ca* Feeding Line
32*cb* Feeding Line
33 Substrate
35 Main Lobe of Broadside Array
35' Main Lobe of Broadside Array
40 End-Fire Array Antenna
40*a* Monopole
40*b* Monopole
40*c* Monopole
40*d* Monopole
40*e* Monopole
40*f* Monopole
41*a* Radiating Element
41*b* Radiating Element
41*c* Radiating Element
41*d* Radiating Element
41*e* Radiating Element
41*f* Radiating Element
42*a* Feeding Line
42*b* Feeding Line
42*c* Feeding Line
42*d* Feeding Line
42*e* Feeding Line
42*f* Feeding Line
43 Ground Plane
45 Main Lobe of End-Fire Antenna
45' Main Lobe of End-Fire Antenna
50 Array Antenna
50*a* Dipole
50*b* Dipole
50*c* Dipole
51*aa* Horizontal Radiating Element
51*ab* Horizontal Radiating Element
51*ba* Horizontal Radiating Element
51*bb* Horizontal Radiating Element
51*ca* Horizontal Radiating Element
51*cb* Horizontal Radiating Element
52*aa* Feeding Line
52*ab* Feeding Line
52*ba* Feeding Line
52*bb* Feeding Line
52*ca* Feeding Line
52*cb* Feeding Line
53 Ground Plane
54*aa* Vertical Radiating Element
54*ab* Vertical Radiating Element
54*ba* Vertical Radiating Element
54*bb* Vertical Radiating Element
54*ca* Vertical Radiating Element
54*cb* Vertical Radiating Element
55 Main Lobe of Broadside Array
55' Main Lobe of End-Fire Array
55" Main Lobe of End-Fire Array
56*aa* Upper Distributing End
56*ab* Upper Distributing End
56*ba* Upper Distributing End
56*bb* Upper Distributing End
56*ca* Upper Distributing End
56*cb* Upper Distributing End
57*aa* Lower Feeding End
57*ab* Lower Feeding End
57*ba* Lower Feeding End
57*bb* Lower Feeding End
57*ca* Lower Feeding End
57*cb* Lower Feeding End
60*a* Feeding Device (Balun)
60*c* Feeding Device (Balun)
62*a* Feeding Line
62*c* Feeding Line
64*a* Two-Way Switch
64*c* Two-Way Switch
65*a* Phase Shifter (Mode Shift)

66*c* Phase Shifter (Mode Shift)
66*a* Phase Shifter (Main Lobe Scanning)
66*c* Phase Shifter (Main Lobe Scanning)
67*a* Power Divider/Combiner
67*c* Power Divider/Combiner
600*a* Feeding Arrangement
600*c* Feeding Arrangement
620*a* Feeding Arrangement
620*c* Feeding Arrangement
E1 Extension, Radiating Element
E2 Extension, Radiating Element
DP1 Horizontal Dipole Axis
DP2 Horizontal Dipole Axis
DP3 Horizontal Dipole Axis
MP Vertical Monopole Axis
MPa Vertical Monopole Axis
MPb Vertical Monopole Axis
MPc Vertical Monopole Axis
MPd Vertical Monopole Axis
MPe Vertical Monopole Axis
MPf Vertical Monopole Axis
MPaa Vertical "Monopole" Axis
MPab Vertical "Monopole" Axis
MPba Vertical "Monopole" Axis
MPbb Vertical "Monopole" Axis
MPca Vertical "Monopole" Axis
MPcb Vertical "Monopole" Axis
L1 Line/Row of Monopoles
L2 Line/Row of Monopoles

What is claimed is:

1. An array antenna comprising:

a region of reference potential and a spatially extended collection of at least two antenna elements capable of being at least partly balanced driven and at least partly unbalanced driven, wherein said antenna elements further comprise:

a first radiating element coupled to a first port, and a second radiating element coupled to a second port, which radiating elements are arranged substantially adjacent and parallel to each other so as to extend at least a first distance approximately perpendicularly from said region;

a radiating arrangement coupled to said first and second radiating elements so as to extend at least a second distance above and approximately parallel to said region, wherein the first and second ports of each antenna element are coupled to a feeding arrangement wherein the feeding arrangement is arranged to vary the phase difference ϕ between a first signal communicated between the first port and the feeding arrangement and a second signal communicated between the second port and the feeding arrangement and further wherein the feeding arrangement further comprises a device arranged so that a signal (IQ) communicated with a first terminal of the device is divided with a first substantially fixed phase difference ϕ-j between said first signal and said second signal and a signal communicated with a second terminal of the device is divided with a second substantially fixed phase difference between said first signal and said second signal.

2. The array antenna according to claim 1, wherein the first device terminal and the second device terminal is connected to a switch, which in a first position enables the signal to be communicated with the first device terminal and in a second position enables the signal to be communicated with the second device terminal.

3. An array antenna comprising:

a region of reference potential and a spatially extended collection of at least two antenna elements capable of being at least partly balanced driven and at least partly unbalanced driven, wherein said antenna elements further comprise:

a first radiating element coupled to a first port, and a second radiating element coupled to a second port, which radiating elements are arranged substantially adjacent and parallel to each other so as to extend at least a first distance approximately perpendicularly from said region;

a radiating arrangement coupled to said first and second radiating elements so as to extend at least a second distance above and approximately parallel to said region, wherein the first and second ports of each antenna element are coupled to a feeding arranqement wherein the feeding arrangement is arranged to vary the phase difference ϕ between a first signal communicated between the first port and the feeding arrangement and a second signal communicated between the second port and the feeding arrangement and further wherein the feeding arrangement further comprises a distribution arrangement coupled to said first and second ports and to a feeding line and being arranged so as to combine signals received from said ports into said feeding line and to divide a signal received from said feeding line between said ports and at least one phase shifter coupled between at least one of said ports and said distribution arrangement so as to varying the phase ϕ of a signal communicated between that port and the distribution arrangement.

4. A method for transmitting or receiving electromagnetic radiation by antenna elements in a variable direction by using an array antenna. comprising the steps of:

providing in the array antenna a region of reference potential and a spatially extended collection of at least two antenna elements capable of being at least partly balanced driven and at least partly unbalanced driven;

providing said antenna elements with a first radiating element coupled to a first port and a second radiating element coupled to a second port, which radiating elements are arranged substantially adjacent and parallel to each other so as to extend at least a first distance approximately perpendicularly from said region;

providing a radiating arrangement coupled to said first and second radiating elements so as to extend at least a second distance above and approximately parallel to said region;

varying the phase difference ϕ between a first signal ($J_i$) communicated with the first port of the antenna element and a second signal ($Z_2$) communicated with the second port, wherein the phase difference ϕ is generated utilizing a feeding arrangement coupled to the first and second port of each antenna element that varies the phase difference ϕ between a first signal communicated between said first port and said feeding arrangement and a second signal communicated between said second port and said feeding arrangement, and arranging the feeding arrangement so that a signal communicated with a first terminal of the device is divided with a first substantially fixed phase difference ϕ between said first signal and said second signal, and a signal communicated with a second terminal of the device is divided with a second substantially fixed phase difference between said first signal and said second signal.

5. A method for transmitting or receiving electromagnetic radiation by antenna elements in a variable direction by using an array antenna, comprising the steps of:

providing in the array antenna a region of reference potential and a spatially extended collection of at least two antenna elements capable of being at least partly balanced driven and at least partly unbalanced driven;

providing said antenna elements with a first radiating element coupled to a first port and a second radiating element coupled to a second port, which radiating elements are arranged substantially adjacent and parallel to each other so as to extend at least a first distance approximately perpendicularly from said region;

providing a radiating arrangement coupled to said first and second radiating elements so as to extend at least a second distance above and approximately parallel to said region;

varying the phase difference $\phi$ between a first signal ($J_i$) communicated with the first port of the antenna element and a second signal ($Z_2$) communicated with the second port, wherein the phase difference $\phi$ is generated utilizing a feeding arrangement coupled to the first and second port of each antenna element that varies the phase difference $\phi$ between a first signal communicated between said first port and said feeding arrangement and a second signal communicated between said second port and said feeding arrangement, and coupling the first device terminal and the second device terminal to a switch so that in a first position the signal is communicated with the first device terminal and so that in a second position the signal is communicated with the second device terminal.

6. A method for transmitting or receiving electromagnetic radiation by antenna elements in a variable direction by using an array antenna, comprising the steps of:

providing in the array antenna a region of reference potential and a spatially extended collection of at least two antenna elements capable of being at least partly balanced driven and at least partly unbalanced driven;

providing said antenna elements with a first radiating element coupled to a first port and a second radiating element coupled to a second port, which radiating elements are arranged substantially adjacent and parallel to each other so as to extend at least a first distance approximately perpendicularly from said region;

providing a radiating arrangement coupled to said first and second radiating elements so as to extend at least a second distance above and approximately parallel to said region;

varying the phase difference $\phi$ between a first signal ($J_i$) communicated with the first port of the antenna element and a second signal ($Z_2$) communicated with the second port, wherein the phase difference $\phi$ is generated utilizing a feeding arrangement coupled to the first and second port of each antenna element that varies the phase difference $\phi$ between a first signal communicated between said first port and said feeding arrangement and a second signal communicated between said second port and said feeding arrangement, and accomplishing the phase difference $\phi$ by utilizing a feeding arrangement wherein a distribution arrangement is connected to said first and second ports and to a feeding line and being arranged so as to combine signals received from said ports into said feeding line and to divide a signal received from said feeding line between said ports, and at least one phase shifter is coupled between at least one of said ports and said distribution arrangement so as to vary the phase $\phi$ of a signal communicated between that port and the distribution arrangement.

* * * * *